US012566016B2

(12) United States Patent
Barg et al.

(10) Patent No.: US 12,566,016 B2
(45) Date of Patent: Mar. 3, 2026

(54) AUTONOMOUS PORTABLE REFRIGERATION UNIT

(71) Applicant: Delta Development Team, Inc., Tucson, AZ (US)

(72) Inventors: William Barg, Tucson, AZ (US); Christopher Bridgewater, Tucson, AZ (US); Robert Futch, Tucson, AZ (US); Montgomery Leija, Sahuarita, AZ (US)

(73) Assignee: Delta Development Team, Inc., Tucson, AZ (US)

( * ) Notice: Subject to any disclaimer, the term of this patent is extended or adjusted under 35 U.S.C. 154(b) by 169 days.

(21) Appl. No.: 18/189,130

(22) PCT Filed: Nov. 9, 2021

(86) PCT No.: PCT/US2021/058553
§ 371 (c)(1),
(2) Date: Mar. 23, 2023

(87) PCT Pub. No.: WO2022/103723
PCT Pub. Date: May 19, 2022

(65) Prior Publication Data

US 2024/0011688 A1 Jan. 11, 2024

Related U.S. Application Data

(60) Provisional application No. 63/112,525, filed on Nov. 11, 2020.

(51) Int. Cl.
*F25B 49/02* (2006.01)
*F25B 13/00* (2006.01)
*F25D 11/00* (2006.01)

(52) U.S. Cl.
CPC ..... *F25B 49/02* (2013.01); *F25B 13/00* (2013.01); *F25D 11/00* (2013.01)

(58) Field of Classification Search
CPC .... A61J 2200/44; A61J 2200/72; A61J 1/165; F25B 49/022; F25B 31/00; F25B 39/04;
(Continued)

(56) References Cited

U.S. PATENT DOCUMENTS 3,178,896 A * 4/1965 Sandsto ..... F25B 21/02 62/437
5,950,450 A 9/1999 Meyer et al.
(Continued)

FOREIGN PATENT DOCUMENTS

CN 108139107 A * 6/2018 ..... F24F 11/72
CN 109674171 A * 4/2019 ..... F25B 21/02
(Continued)

OTHER PUBLICATIONS

KR-20030089819-A English Translation (Year: 2003).*
(Continued)

*Primary Examiner* — Frantz F Jules
*Assistant Examiner* — Devon Moore
(74) *Attorney, Agent, or Firm* — KW Law, LLP

(57) ABSTRACT

Systems, methods, and devices may include a cooled storage system with a case having an outer bucket with a first bottom wall and a first sidewall. The outer bucket may include a flange protruding from the first sidewall. An inner bucket may be disposed at least partially within the outer bucket and may include a second bottom wall and a second sidewall defining a storage compartment in the case. A coil may be at least partially disposed in the volume between the inner bucket and the outer bucket with a phase-change material disposed about the coil. An electronic control system may actively and passively cool the storage compartment resulting in extremely efficient and precise temperature control.

18 Claims, 15 Drawing Sheets

(58) Field of Classification Search
CPC ..... F25D 11/00; F25D 11/003; F25D 11/006; F25D 3/005; F25D 3/06; F25D 3/08; F25D 19/003; F25D 23/003; F25D 23/006; F25D 9/003; F25D 29/008; F25D 2201/00; F25D 2201/10; F25D 2331/8014; F25D 2331/804; F25D 2400/12; F25D 2700/12; F25D 19/00; F25D 3/105; F25D 16/00; B65D 81/18; B65D 81/38
See application file for complete search history.

(56) References Cited

U.S. PATENT DOCUMENTS

| | | | | |
|---|---|---|---|---|
| 6,729,157 | B2 | 5/2004 | Oshitani et al. | |
| 7,007,501 | B2 | 3/2006 | Hu | |
| 7,231,775 | B2 | 6/2007 | Dilk et al. | |
| 9,016,070 | B2 | 4/2015 | Boarman | |
| 9,366,483 | B2 | 6/2016 | Eckhoff et al. | |
| 9,389,013 | B2 * | 7/2016 | Rolek | A47F 3/0426 |
| 9,523,522 | B2 * | 12/2016 | Chou | F25B 49/02 |
| 9,726,418 | B2 | 8/2017 | Chou et al. | |
| 9,752,808 | B2 * | 9/2017 | Nakamura | F25B 21/04 |
| 9,821,700 | B2 | 11/2017 | Rajtmajer et al. | |
| 10,240,850 | B1 | 3/2019 | Stine | |
| 10,278,895 | B2 * | 5/2019 | Chou | F25D 3/08 |
| 10,281,180 | B2 | 5/2019 | Ma | |
| 10,508,854 | B2 * | 12/2019 | Demuth | F25D 21/14 |
| 10,634,370 | B2 | 4/2020 | Arjomand | |
| 11,125,474 | B2 * | 9/2021 | Ahmad | F25B 9/04 |
| 11,691,800 | B2 * | 7/2023 | Sanders | B65D 81/18 220/592.01 |
| 2003/0010784 | A1 | 1/2003 | Schlosser | |
| 2011/0259041 | A1 * | 10/2011 | Kuehl | F28D 1/0477 62/507 |
| 2014/0157794 | A1 * | 6/2014 | McGann | F25D 11/003 62/3.2 |
| 2017/0290741 | A1 | 10/2017 | Chou et al. | |
| 2017/0314839 | A1 | 11/2017 | van Beek et al. | |
| 2019/0003469 | A1 * | 1/2019 | Hayamizu | F24F 5/0089 |
| 2021/0278109 | A1 * | 9/2021 | Menta | F25B 21/02 |
| 2024/0166423 | A1 * | 5/2024 | Ganahl | B65D 81/3876 |

FOREIGN PATENT DOCUMENTS

| | | | | |
|---|---|---|---|---|
| JP | 2004294016 | A * | 10/2004 | F25D 31/007 |
| KR | 20030089819 | A * | 11/2003 | F25B 39/04 |
| KR | 20130004863 | A | 1/2013 | |
| WO | WO-9738661 | A1 * | 10/1997 | A61J 1/165 |
| WO | 2005019747 | A1 | 3/2005 | |
| WO | 2015081058 | A1 | 6/2015 | |

OTHER PUBLICATIONS

WO-9738661-A1 English Translation (Year: 1997).*
JP-2004294016-A English Translation (Year: 2004).*
CN-109674171-A English Translation (Year: 2019).*
CN-108139107-A English Translation (Year: 2018).*
Judgment, PGR2021-00085, U.S. Pat. No. 10,766,685 B2, dated Jun. 16, 2023 (80 pages).
PCT International Search Report for International Application No. PCT/US21/58553 dated Apr. 13, 2022 (4 pages).
Written Opinion of the International Searching Committee for International Application No. PCT/US21/58553 dated Apr. 13, 2022 (6 pages).

* cited by examiner

AUTONOMOUS PORTABLE REFRIGERATION UNIT

CROSS-REFERENCE TO RELATED APPLICATIONS

The present application claims priority to and the benefit of PCT Patent Application No. PCT/US21/58553 entitled "Autonomous Portable Refrigeration Unit" and filed on Nov. 9, 2021, which claims priority to U.S. Provisional Patent Application No. 63/112,525 entitled "Autonomous Portable Refrigeration Unit" and filed on Nov. 11, 2020, which are incorporated by reference in their entirety for any purpose.

GOVERNMENT LICENSE RIGHTS

This invention was made with government support under FA8652-19-P-W106 Mar. 6, 2019 awarded by United States Department of the Air Force, Air Force Research Laboratory ("AFRL"). This invention was made with government support under FA8629-20-C-5007 Oct. 29, 2019 awarded by United States Department of the Air Force, Air Force Life Cycle Management Center ("AFLCMC"). The government has certain rights in the invention.

FIELD

The present disclosure relates to refrigeration system and more specifically to autonomous portable refrigeration unit.

BACKGROUND

Medical conditions may not always arise in ideal conditions, and a hospital may not be available when they do. A patient in the field may suffer conditions that merit emergent treatment with advanced techniques typically only available in a hospital or treatment facility. A wounded individual may be treatable with a blood transfusion, for example, in a hospital or other facility with the ability to maintain donor blood.

However, some techniques of modern medicine may be unavailable in the field due to temperature, climate, or other environmental factors. Blood is temperature sensitive. Refrigeration systems are commonly used in home, commercial, or industrial applications to store blood where AC power is available. Blood availability may thus be limited in locations disconnected from a power grid or generator.

Rudimentary cooling techniques like ice or pre-cooling maintain temperatures for limited time and offer limited temperature control. The temperature inside a typical cold storage device may be heavily influenced by the temperature outside the container. Ambient conditions including extreme heat can further limit effectiveness of passive systems such as insulated ice boxes.

SUMMARY

Systems, methods, and devices of the present disclosure may include one or more computers configured to perform particular operations or actions by virtue of having software, firmware, hardware, or a combination of them installed on the system that in operation causes or cause the system to perform the actions. One or more computer programs can be configured to perform particular operations by virtue of including instructions that, when executed by data processing apparatus, cause the apparatus to perform the actions.

In various embodiments, the systems, methods, and devices may include a cooled storage system. The cooled storage system may include a case with an outer bucket having a first bottom wall and a first sidewall. The outer bucket may include a flange protruding from the first sidewall. An inner bucket may be disposed at least partially within the outer bucket and may include a second bottom wall and a second sidewall defining a storage compartment in the case. The inner bucket may include a second flange protruding from the second sidewall. The second flange may engage and seal against the first flange to define a volume between the inner bucket and the outer bucket.

In various embodiments, the systems, methods, and devices may include an electronic control system coupled to the case and configured to maintain a predetermined temperature in the storage compartment. A refrigeration system may be disposed in the case and may have a compressor and a first heatsink with cooling fins exposed from the case. The first heatsink may be in thermal communication with the compressor and have a contour to receive the compressor. A condenser may have an inlet in fluid communication with an outlet of the compressor. A second heatsink may include cooling fins exposed from the case. The second heatsink may be in thermal communication with the condenser and may have a contour to receive the condenser. An expansion valve may have an inlet in fluid communication with an outlet of the condenser. An evaporator may include a coil. An inlet of the coil may be in fluid communication with the outlet of the expansion valve. An outlet of the coil may be in fluid communication with the inlet of the compressor. The coil may be at least partially disposed in the volume between the inner bucket and the outer bucket. A phase-change material may be disposed in the volume between the inner bucket and the outer bucket. The evaporator may be at least partially submerged in the phase-change material.

The systems, methods, and devices may include a cooled storage system where the case is insulated with an R value of at least 35° F.*ft2*h/btu per inch. The lid may seal the storage compartment in response to being in a closed position. The phase-change material may include a thermal storage capacity of approximately 200 j/gr. The outer bucket may include a rim defining a channel for the inlet of the coil and the outlet of the coil to exit the volume. The phase-change material may absorb heat from the storage compartment and heats the coil of the evaporator. The cooled storage system may include a battery disposed in the case and in electronic communication with the compressor. The cooled storage system may include an electronic control system in electronic communication with the battery and the compressor. The electronic control system may be configured to maintain a predetermined temperature in the storage compartment. The user interface may be configured to alarm in response to at least one of a measured temperature in the storage compartment, a historical temperature measured in the storage compartment, and remaining power in the battery. The cooled storage system may include a communication system mounted in the case and in electronic communication with the electronic control system and the user interface system.

The systems, methods, and devices may include a portable refrigeration unit. The portable refrigeration unit may include a case. The unit may further include an outer bucket disposed in the case and coupled to the case. The unit may include an inner bucket disposed at least partially within the outer bucket, where a sealed volume is defined between the inner bucket and the outer bucket, and where interior surfaces of the inner bucket define a storage compartment. The unit may include an electronic control system coupled to the case and configured to maintain a predetermined temperature in the storage compartment. The unit may include a refrigeration system disposed in the case and may include an evaporator coil disposed at least partially in the sealed volume between the inner bucket and the outer bucket. The unit may include a phase-change material disposed in the sealed volume between the inner bucket and the outer bucket where the evaporator is at least partially submerged in the phase-change material.

Various embodiments may include one or more of the following features. The portable refrigeration unit may include a compressor disposed in the case and outside of the outer bucket, the compressor in fluid communication with the evaporator. The portable refrigeration unit may be configured to cool the storage compartment to a predetermined temperature and then allow the compressor to idle in response to the phase-change material melting.

In various embodiments, a method of cooling a portable refrigeration unit may include running a compressor to cool a storage compartment and to freeze a phase-change material disposed in a volume defined about the storage compartment. The phase-change material may at least partially surround an evaporator disposed in the volume defined about the storage compartment. The method may include receiving a first temperature measurement of the phase-change material from a thermal sensor disposed in the volume defined about the storage compartment. The first temperature measurement may be compared to a predetermined cooling-target temperature. The compressor may stop in response to the first measured temperature being less than or equal to a cooling-target temperature. The cooling may include melting the phase-change material by stopping the compressor. The electronic control system may maintain a predetermined temperature in the storage compartment in response to melting the phase-change material melting while the compressor is stopped.

In various embodiments, the method may include receiving a second temperature measurement of the phase-change material, and restarting the compressor in response to the second temperature measurement being greater than or equal to a warming-target temperature. The warming-target temperature may be set in the electronic control system as a constant equal to a melting point of the phase-change material plus a temperature offset. The temperature offset may be one of about 0.5° C., about 1° C., about 2° C., about 3° C., or about 4c. The cooling-target temperature may be set in the electronic control system as a constant equal to a melting point of the phase-change material minus a temperature offset. The temperature offset may be one of about 0.25° C., about 0.5° C., about 0.75° C., or about 1° C. The method may include actuating an expansion valve in response to a superheat measured at an outlet of the evaporator disposed in the volume.

BRIEF DESCRIPTION

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
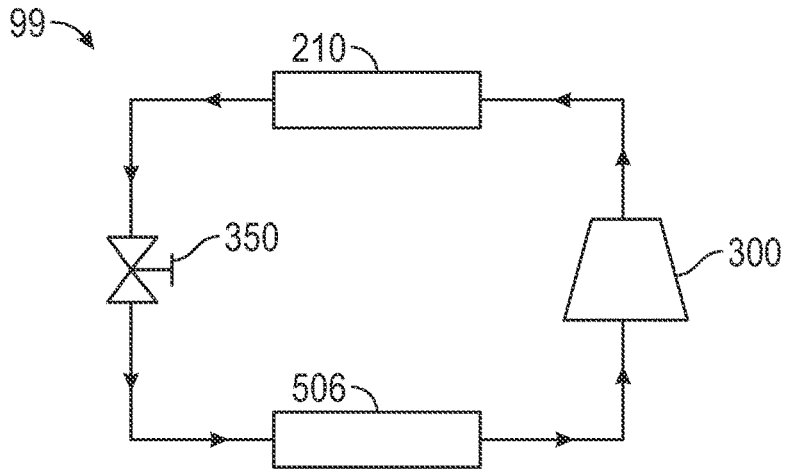
FIG. 1 illustrates a schematic view of a refrigeration system, in accordance with various embodiments.

The detailed description of exemplary embodiments herein refers to the accompanying drawings, which show exemplary embodiments by way of illustration. While these exemplary embodiments are described in sufficient detail to enable those skilled in the art to practice the inventions, other embodiments may be realized, and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

The present disclosure is directed to portable refrigeration systems. Portable refrigeration systems of the present disclosure may generally cool a storage compartment for extended periods in extreme conditions. Such systems may operate without electrical connection to a power grid or generator to cool contents such as blood, for example.

As used herein, phase-change material ("PCM") refers to a material used to absorb or dissipate thermal energy during various modes of operation to improve efficiency or capacity of the cooling system. The storage temperature and capacity of a PCM may depend on characteristics of the material selected. PCM heatsinks may be stored at temperatures below maximum operating temperature.

In various embodiments, the systems and methods described herein may provide extended precise temperature control to at least one cold-storage compartment in an Autonomous Portable Refrigeration Unit ("APRU"). The systems may control temperature when the internal refrigeration system is not able to operate using power from a power grid or generator. Refrigeration systems described herein may thus operate where temperature sensitive materials require environmental controls. Refrigeration systems of the present disclosure may be portable and battery-operated.

In various embodiments, the devices described herein may provide access to temperature-controlled blood in hostile conditions often ancillary to military or first responder applications. These environments may include remote operations where standard AC power may be unavailable.

In various embodiments, APRUs of the present disclosure may include a case with low weight and small displacement. APRUs of the present disclosure may further operate from an internal battery tending to have the minimal capacity and size suitable to run the vapor compression system maintaining a temperature set-point in the storage compartment.

In various embodiments, APRUs of the present disclosure may be suitable for use outdoors in wet and dusty conditions. APRUs of the present disclosure may also tend to withstand shock, vibration, and rapid altitude changes. APRUs of the present disclosure may further operate in ambient temperatures is less than the predetermined storage temperature by delivering supplemental heating to maintain the temperature set-point. Cold storage systems described herein may also be Electromagnetic Interference (EMI) resistant.

The cold storage systems described herein may be configured to survive a 48 inch drop on each face, edge and corner for a total of at least 26 drops. The cold storage system may be configured to survive in hot environments (Heat Deflection Temperature (@1.82 MPa), greater than 100° C.). The cold storage system may be configured to survive impact in cold weather (Izod Impact, notched −30° C. impact greater than 40 kj/m$^2$, Yield strength>50 Mpa or ASTM D746).

In various embodiments and with reference to FIG. 1, refrigeration system 99 may be a vapor compression system. Refrigeration system 99 may comprise compressor 300 in fluid communication with the evaporator 506 comprising traversing, wound, or zig-zagging coils. Refrigeration system 99 may comprise a system controller to receive on/off/speed commands applicable to the compressor or valves.

In various embodiments, electronic control system 240 (ECS) may be in electronic communication with compressor 300 and evaporator 506. refrigeration system 99 may include at least one condenser 210 comprising traversing, wound, zig-zigging, or otherwise shaped conduit (also referred to as coils herein) in fluid communication with an outlet of compressor 300. System 99 may include expansion valve 350 in fluid communication with condenser 210 and operatively coupled at the expansion valve 350 outlet to the evaporator 506 inlet. The condenser 210 may receive pressurized refrigerant in a vapor state from compressor 300 through a discharge line.

In various embodiments, refrigerant in the coils of the condenser 210 may be cooled using a cooling media such as water, air (a fan), or other dissipation system which carries away heat. Refrigerant may be condensed in the condenser 210 leaving with a reduced in temperature and pressure entering expansion valve 350. Expansion valve 350 may throttle the liquid refrigerant down to a lower pressure and to regulate the flow of refrigerant through the system.

In various embodiments, the expansion process may reduce temperature and pressure of refrigerant entering evaporator 506. Evaporator 506 may bring refrigerant into heat transfer with the object or area being cooled. In that regard, evaporator 506 and condenser 210 may comprise heat exchangers. Refrigerant in evaporator 506 at a reduced pressure may absorb heat from the object media, which vaporizes the refrigerant. Refrigerant vapor may be drawn from evaporator 506 into compressor 300 and compressed. Sensors may be placed throughout the refrigeration system and may be in communication with the electronic control system, as described in greater detail below.

Figure 2:
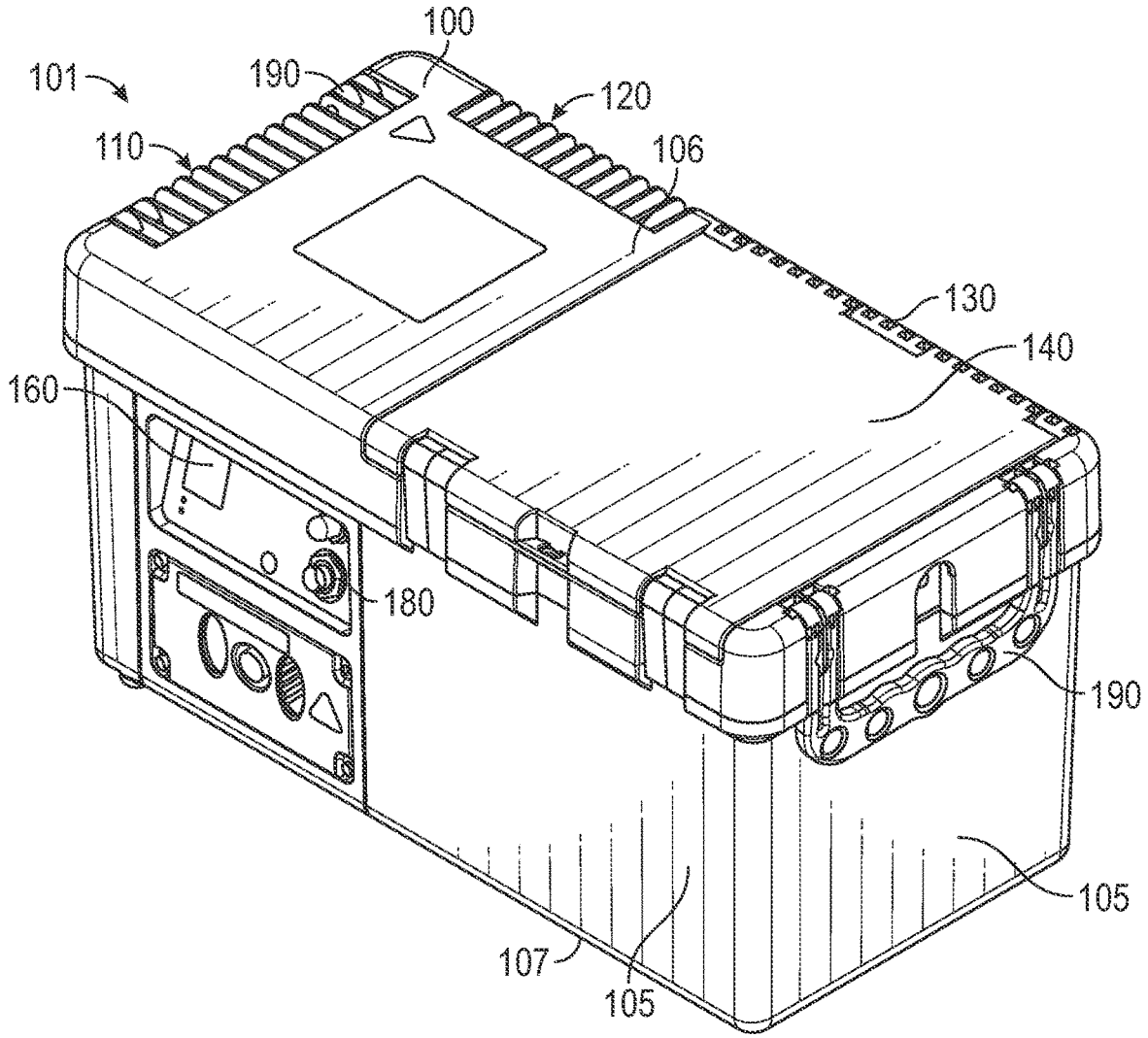
FIG. 2 illustrates a perspective view of an Autonomous Portable Refrigeration Unit ("APRU"), in accordance with various embodiments.

In various embodiments and with reference to FIG. 2, APRU 101 may be enclosed in a portable, rugged, or sealed case 100. APRU 101 may weigh less than 351b (16 Kg). The APRU system may operate autonomously to maintain a temperature setpoint within a storage compartment. The temperature setpoint may reflect the temperature maintained in the storage compartment. The APRU may tend to maintain a tight range of temperatures in response to the setpoint. For example, the setpoint may maintain a temperature of 4° C. to 5° C. in the storage compartment. During such operation, cold-storage temperature regulation and user communication may be performed using a microprocessor and memory subassembly. A microprocessor and memory subassembly may manage the transmittal of APRU system health data and storage compartment temperature history as a measure of storage compartment content viability.

In various embodiments, the APRU may operate in ambient temperatures of approximately −25° F. to 120° F. (−32° C. to 50° C.). The APRU may charge the battery in response to electricity being available through electrical connections.

In various embodiments, case 100 may be an APRU Case. Case 100 may include case bottom 107, sides 105, top 106. Case bottom 107 may serve as the main support structure for mounting internals and presenting user interfaces. Case 100 may house heatsink 110 and heatsink 120. Condenser heatsink 110 and heatsink 120 may be integrated into the sides of the case. Heat exchangers in case 100 may be sealed and affixed to the case 100. Heat exchangers may structure store or dissipate heat and may be in fluid communication with condenser 210 and compressor 300.

In various embodiments, case 100 may include handles 190 for carrying the APRU. One or more sides 105 may include a user interface panel that includes user interface 160 having a battery indicator and a system input/output electrical connector. Top 106 of case 100 may include an integrated lid assembly 140 and hinges 130. Case 100 may house storage housing 220, which includes the storage compartment 150. Cold storage compartment 150 may house temperature-sensitive content for refrigeration.

Figure 3:
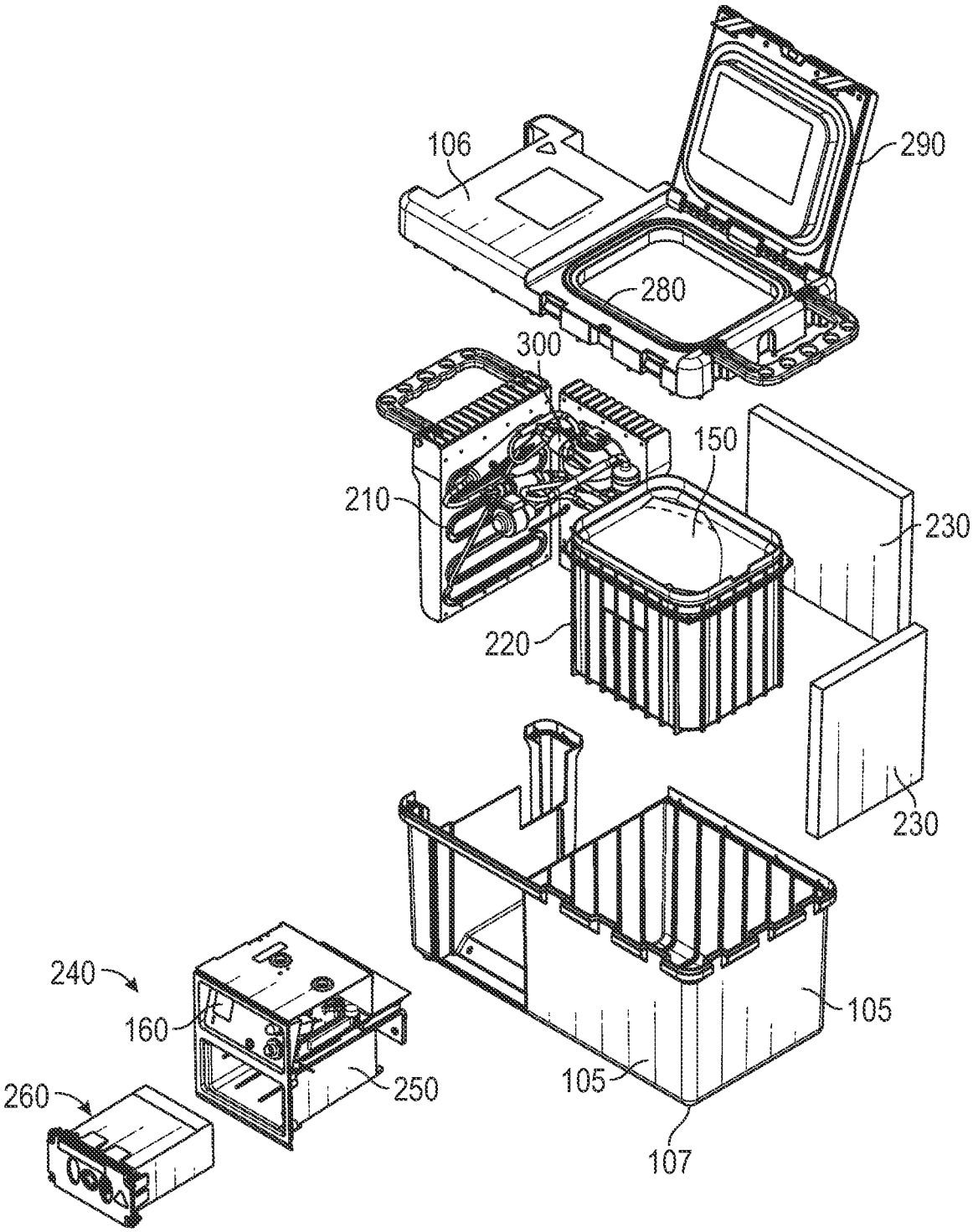
FIG. 3 illustrates an exploded view of an APRU, in accordance with various embodiments.

With reference to FIG. 3, APRU 101 is shown in exploded view, in accordance with various embodiments. APRU 101 may include various subsystems and components within the case 100. Storage housing 220 may comprise insulation panels 230, lid assembly 290, and lid seal 280 to enclose interior space of storage compartment 150. Storage compartment 150 may store temperature-sensitive contents at a predetermined temperature (also referred to as a setpoint).

In various embodiments, APRU 101 may include power and ECS 240 comprising a battery housing and mounting structure 250, the battery 260, and user interface 160 used to power and control APRU 101. User interface 160 may display the APRU system health and cold storage content temperature history.

Figure 4:
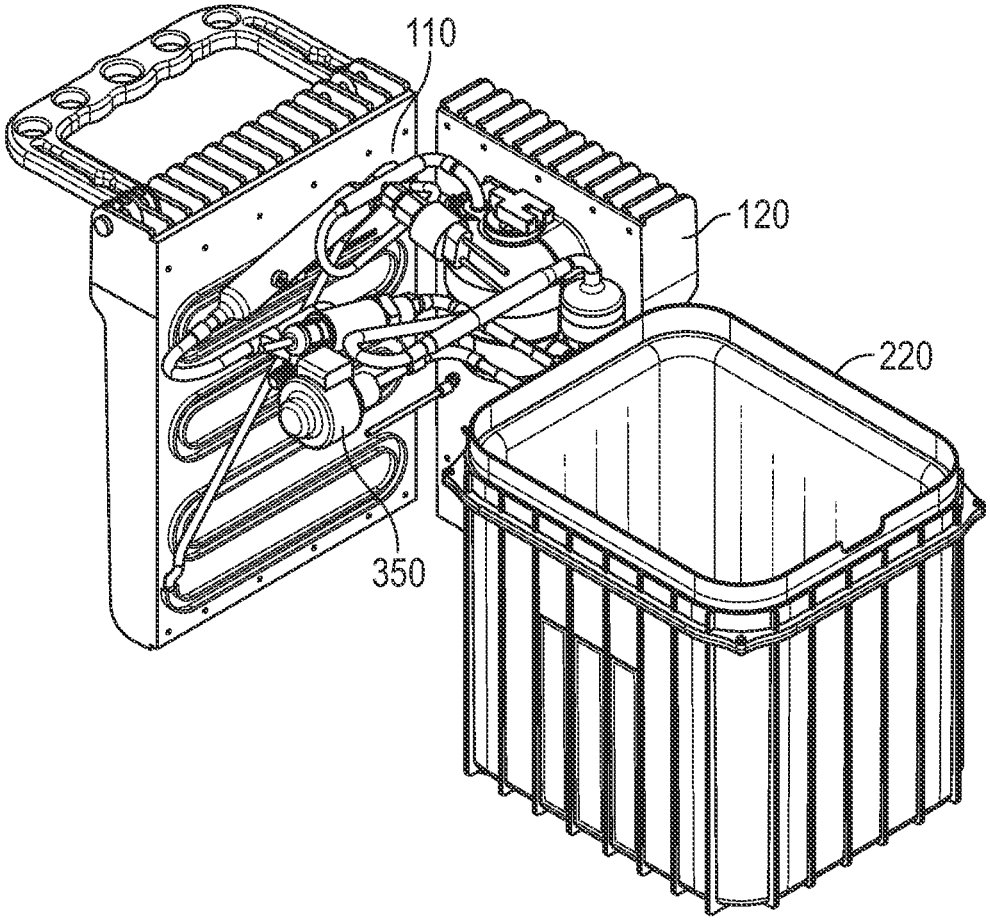
FIG. 4 illustrates a cooling assembly of an APRU, in accordance with various embodiments.

Referring to FIG. 4, a cooling system of APRU 101 is shown, in accordance with various embodiments. Condenser heatsink 110 and heatsink 120 may be integrated into the walls of case 100 (of FIG. 1B) defining sides 105 (of FIG. 1B). Compressor 300, expansion valve 350, pressure sensors, and interconnection lines may be in fluid communication with one another and disposed adjacent to storage housing 220. APRU 101 may house the compressor and condenser coil within case 100 (of FIG. 2) along with power and ECS 240 and storage housing 220.

Figure 5:
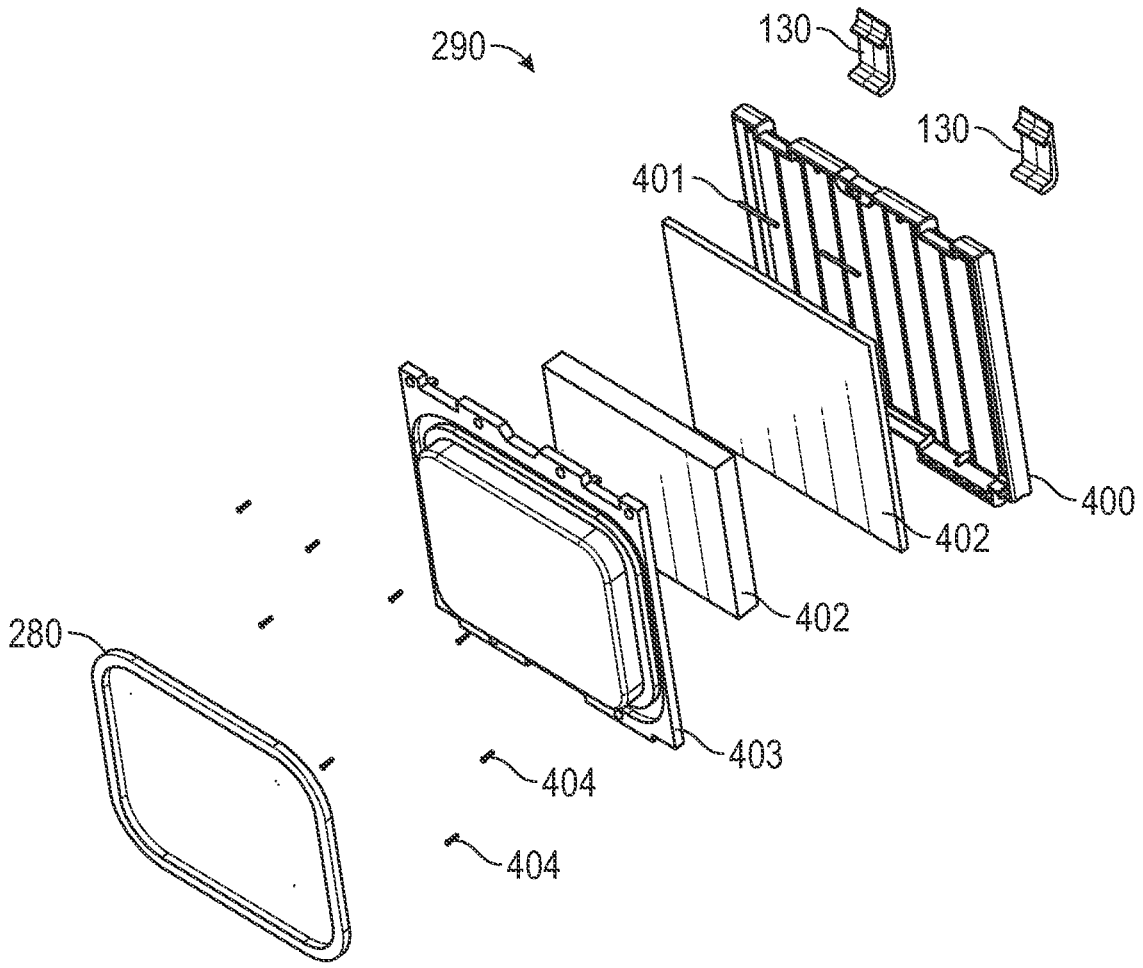
FIG. 5 illustrates an exploded view of a hinged lid for an APRU, in accordance with various embodiments.

In various embodiments and with reference to FIG. 5, lid assembly 290 of the APRU 101 is shown. Lid assembly 290 may comprise lid seal 280, fasteners 404, inner lid 403, lid insulation 402, and outer lid 400. Lid assembly 290 may be fastened together using fasteners 404 passing through clearance holes in the inner lid 403 and threaded into outer lid 400. Lid assembly 290 may include hinges 130 and hinge pins 401 coupled to outer lid 400. Hinges may operate to open and close the storage housing 220. In a closed configuration, lid assembly 290 may tend to thermally isolate the cold storage contents from the external environment. Hinges 130 may include an interference latch system to retain the lid assembly 290 to the case 100 in a closed position.

Figure 6:
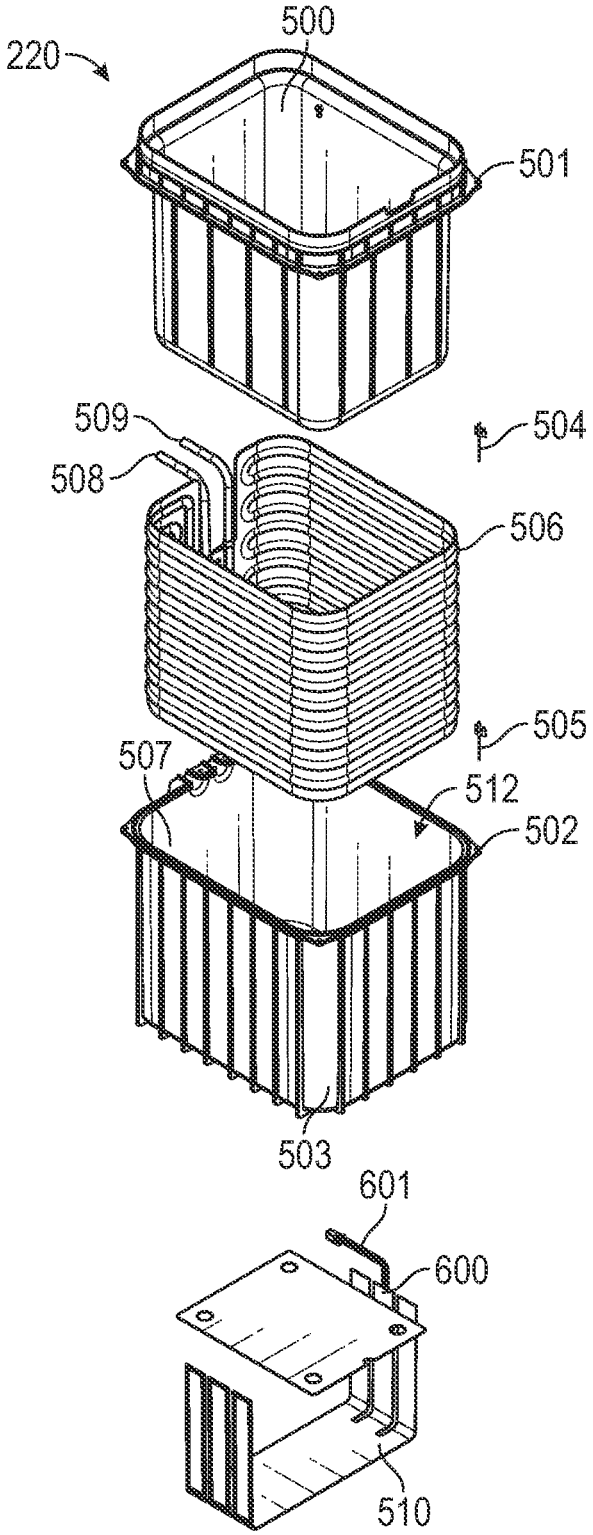
FIG. 6 illustrates an exploded view of a storage container, in accordance with various embodiments.

With reference to FIG. 6, storage housing 220 of APRU 101 is shown, in accordance with various embodiments. Storage housing 220 comprise a rectangular or cuboid shape. Storage housing 220 may have any other size and shape suitable for holding cooled contents. Storage housing 220 may comprise a double-walled configuration. In that regard, storage housing 220 may include inner bucket 500 coupled to outer bucket 503 through adjacent flanges and a seal (e.g., a double walled assembly). Storage housing 220 may be fastened inside the case 100 and may mate with the lid assembly 290 at its top edge. Storage housing 220 may store temperature-sensitive material in a thermally managed volume that tends to be thermally isolated from conditions outside of case 100 (of FIG. 1B).

In various embodiments, inner bucket 500 may comprise a bottom wall and one or more sidewalls with inner surfaces of the bottom wall and sidewalls defining a storage compartment. The storage compartment may open at one side for removal and insertion of contents for storage. Inner bucket 500 may comprise a flange extending away from the one or more sidewalls. The flange may extend substantially perpendicular from inner bucket 500 in an outward direction from the exterior surface of the inner bucket.

In various embodiments, inner bucket 500 may insert in outer bucket 503. Outer bucket 503 may comprise a flange 502 extending outward from an outer surface (e.g., away from inner bucket 500 when inserted in outer bucket 503). Flange 502 may include mating and sealing features suitable for forming a seal with flange 501 and retaining inner bucket 500 within outer bucket 503. Outer bucket 503 may have a contoured rim defining an opening to receive an inlet 508 and an outlet 509 of evaporator 506. The contoured rim may seal against inlet 508 and outlet 509, with flange 502 engaging flange 501. Flange 501 and flange 502 may engage to form a seal. Flange 501 and flange 502 may have a seal disposed between mating surfaces. The volume between inner bucket 500 and outer bucket 503 may be completely or partially sealed to retain PCM within volume 507. Inner bucket 500 and evaporator 506 may be insertable through the opening defined by the rim of outer bucket 503 during assembly or manufacturing.

In various embodiments, a volume 507 may be defined between the outer surfaces of inner bucket 500 and inner surfaces of outer bucket 503. Evaporator 506 may be disposed in volume 507. PCM 512 may be introduced into volume 507 in liquid form and may fill space in volume 507 unoccupied by evaporator 506. Evaporator 506 may be mounted in volume 507 between buckets. Evaporator 506 may be suspended in volume 507 to minimize or prevent contact with inner bucket 500 and outer bucket 503. In that regard, the main body of evaporator 506 may not be in contact with either bucket. PCM 512 may completely or partially fill the remaining volume 507 between the bucket walls that is not occupied by evaporator 506 or other solid contents. The PCM may absorb thermal energy from the interior of the storage compartment 150 tending to cool the interior of storage compartment 150.

In various embodiments, PCM 512 may pass thermal energy to coils of evaporator 506 in response to compressor 300 operating. PCM 512 may change phases (e.g., freeze) in response to transferring heat into evaporator 506. During phase changes from solid-to-liquid, heat may be absorbed from the cold-storage compartment without battery power. In response to phase changes from liquid to solid, heat may be removed from the PCM and transferred to the evaporator 506 when the APRU 101 is actively running compressor 300. Evaporator inlet 508, evaporator outlet 509, sensor 504 (e.g., PCM upper temperature sensor), and sensor 505 (e.g., PCM lower temperature sensor), may protrude into the interior of the storage housing 220. Components protruding from the interior of storage housing 220 may be sealed and insulated.

In various embodiments, heating system 510 may comprise heating element 600 and electrical connector 601. Heating element 600 may be a flexible or formed resistive heating element that heats in response to current applied through the electrical connector 601. The heating element may be in thermal communication with the bottom and/or sides of the storage housing 220. Heating element 600 may heat the contents of the storage housing 220 in response to ambient temperature conditions dropping below the desired internal temperature.

Figure 7:
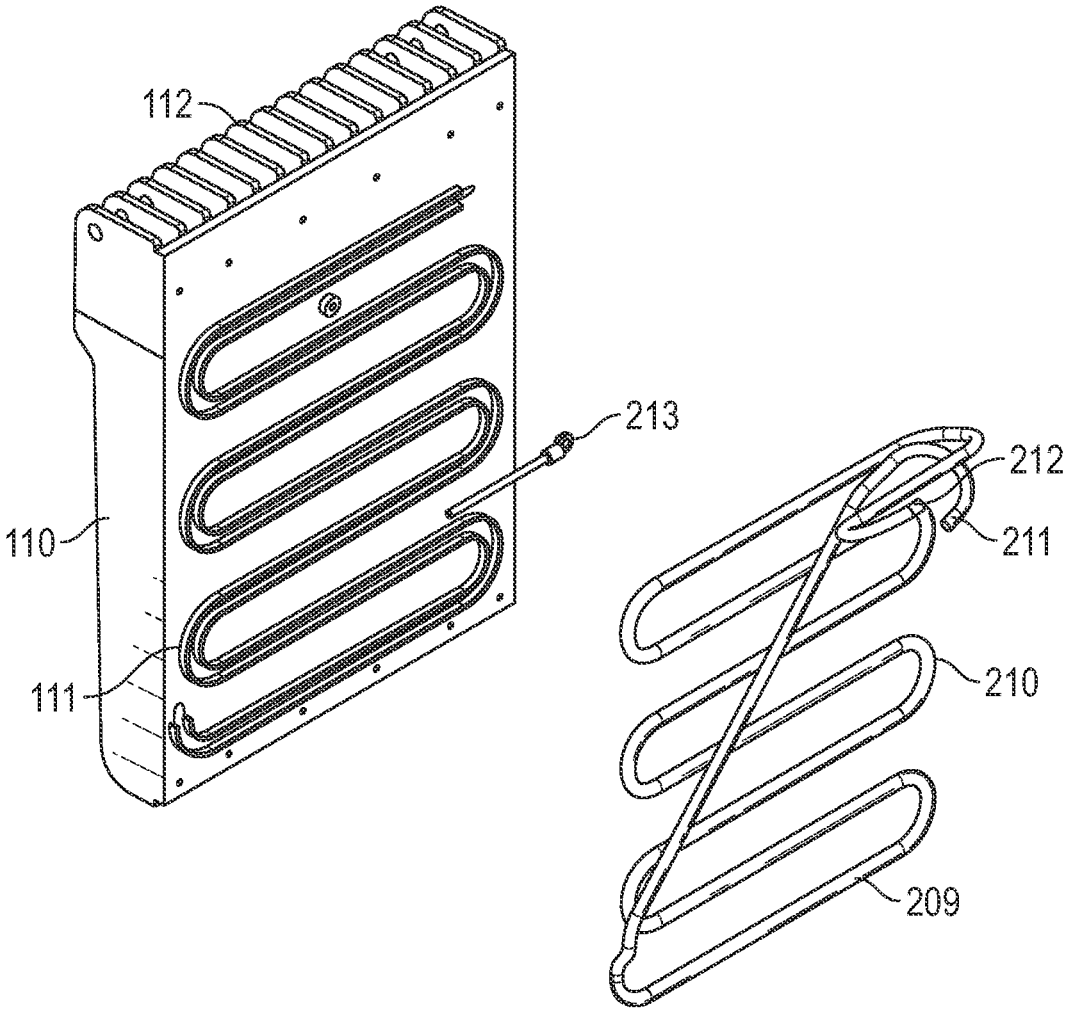
FIG. 7 illustrates a condenser and heatsink assembly of an APRU, in accordance with various embodiments.

With reference to FIG. 7, an exploded view of condenser 210 is shown, in accordance with various embodiments. Condenser 210 may include coil 209, inlet 212, and outlet 211 all in fluid communication. Heatsink 110 may passively cool Condenser 210. Heatsink 110 may comprise a condenser raceway 111 for retaining coil 209 and increasing the contact area between condenser 210 and heatsink 110. In response to coil 209 being fixed to heatsink 110 within the condenser raceway 111, coil 209 may be in thermal communication with heatsink 110. Condenser 210 may transfer heat from a vapor cycle refrigerant to coil 209 and into the heatsink 110. Heat may be expelled through fins 112 and exposed surfaces into air outside case 100 (of FIG. 2). Heatsink 110 may comprise a metallic heatsink, ceramic heatsink, or other suitable material having good heat conduction properties. Temperature sensor 213 may detect the temperature of heatsink 110 or condenser 210.

Figure 8:
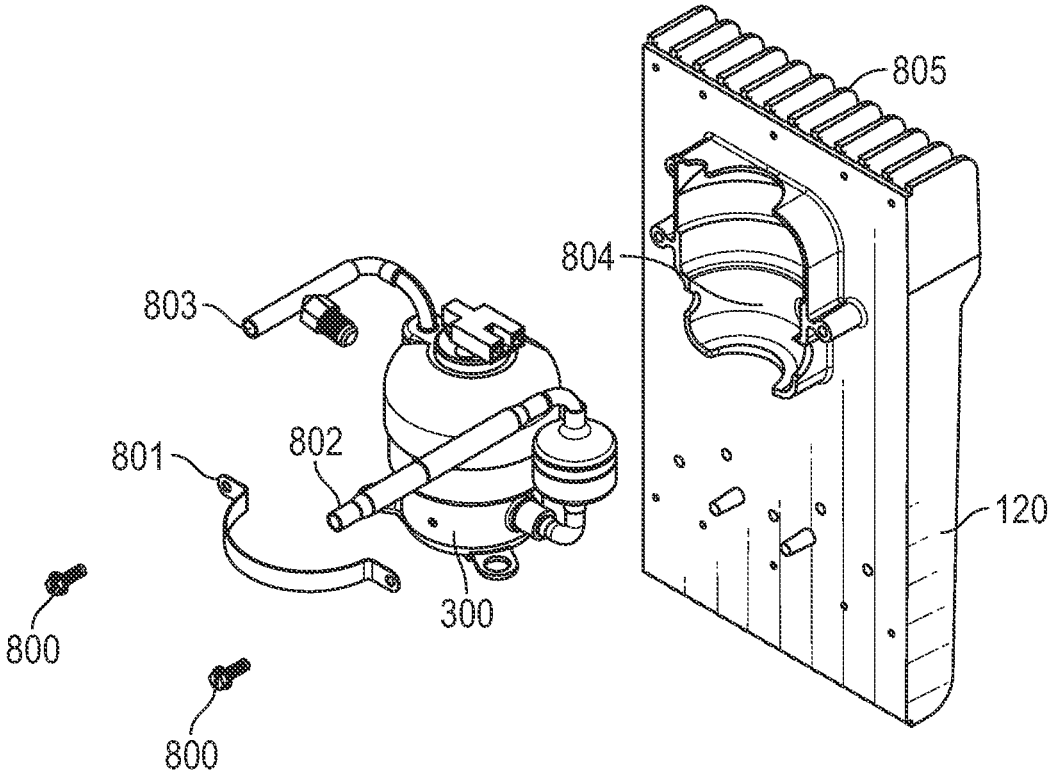
FIG. 8 illustrates a compressor and heatsink assembly of an APRU, in accordance with various embodiments.

Referring now to FIG. 8, compressor 300 is shown in exploded view, in accordance with various embodiments. Compressor 300 may comprise inlet 802, outlet 803, mounting bracket 801, fasteners 800, heatsink 120, and compressor pathway 804. Compressor pathway 804 may be contoured to receive compressor 300 and increase surface contact between compressor 300 and heatsink 120. Compressor 300 may be retained in pathway 804 in response to compressor 300 being fixed in place by bracket 801 and fasteners 800. In response to compressor 300 being fixed to heatsink 120 within the pathway 804, the compressor 300 may be in thermal communication with heatsink 120. Compressor 300 may transfer heat from the compressed vapor cycle refrigerant through the compressor 300 and into the heatsink 120. Heatsink 120 may expel heat though fins 805 or other exposed surfaces into the air outside case 100. Heatsink 120 may comprise a metallic heatsink, ceramic heatsink, or other suitable material having good heat conduction properties.

Figure 9:
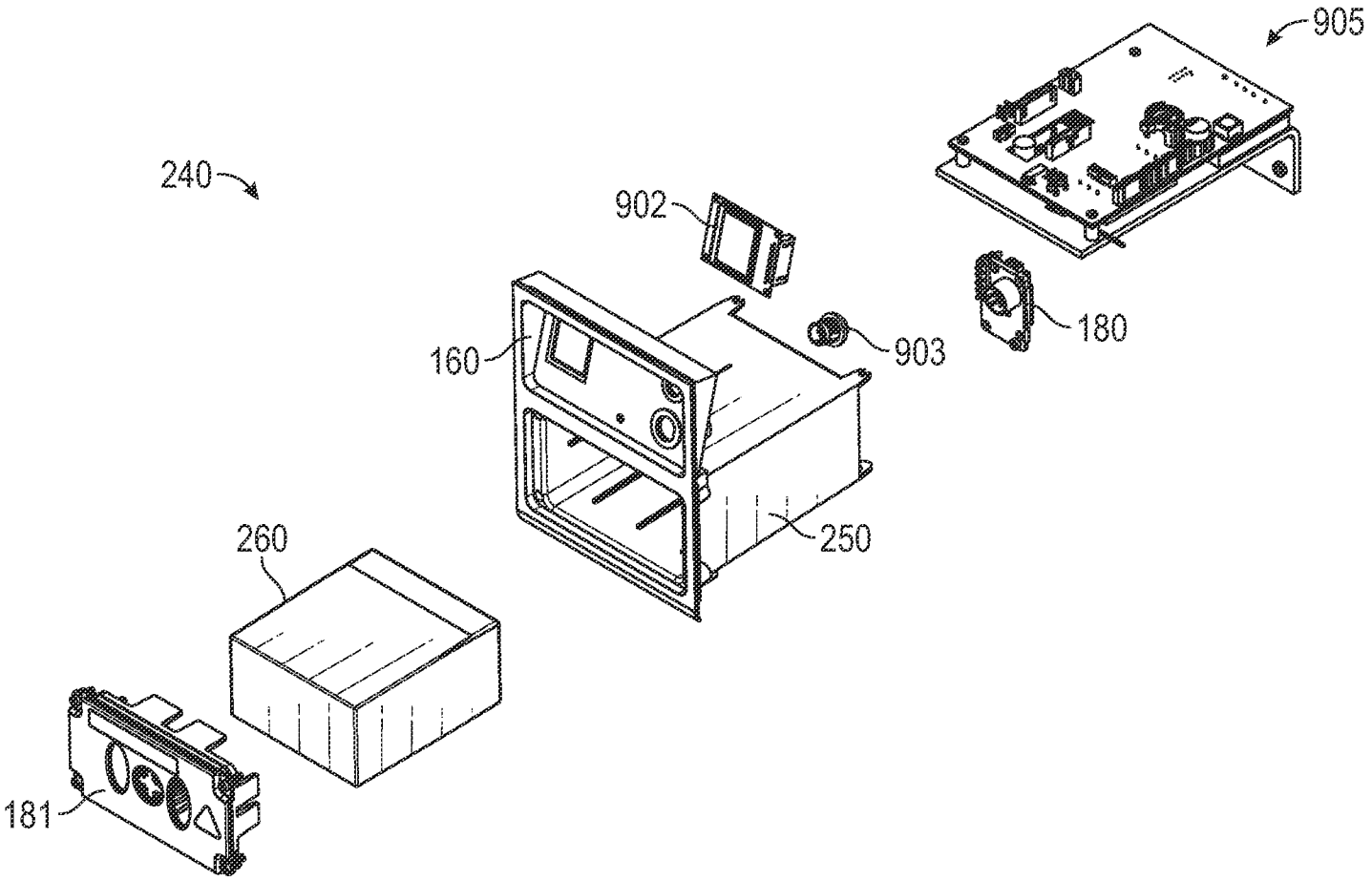
FIG. 9 illustrates an APRU battery and environmental control system, in accordance with various embodiments.

With reference to FIG. 9, an exploded view of ECS 240 is shown, in accordance with various embodiments. ECS 240 may include a microprocessor and memory subassembly 905 fixed to the battery housing and mounting structure 250. ECS 240 may draw electric power from battery 260. ECS 240 may execute stored software instructions to control the configuration and operation of APRU 101. ECS 240 may control refrigeration system 99 (of FIG. 2), control operation of compressor 300, read and store temperature sensor data, and display data on user interface 160. ECS 240 may transmit or receive data over electrical port 180 or port panel 181. ECS 240 may trigger alarm 903 (e.g., an audible or visual alarm) in response to alarm events. Examples of alarm events may include internal temperature outside predetermined ranges, component temperatures outside of operating parameters, limited battery life remaining, or system malfunctions. Battery 260 may be coupled to port panel 181. Port panel 181 may be fastened to mounting structure 250 and electronically coupled to the microprocessor and memory sub assembly.

In various embodiments, ECS 240 may include circuitry configured to send control signals to the compressor and/or other features of the device. ECS 240 may include an electronic controller with circuitry configured to receive signals from components of APRU 101. Components capable of sending signals may include the compressor, sensors, or circuits, for example. ECS 240 may be capable of wireless communication over channels such as WiFi® or Bluetooth®. Transmission and receiving circuits of microprocessor and memory subassembly 905 may facilitate such communication.

In various embodiments, ECS 240 may include circuitry for data acquisition from one or more sensors and/or a power monitor. ECS 240 may include circuitry for temperature control such as by sending a control signal to compressor 300. ECS 240 may include circuitry for visual display or audible alarm electronically. For example, alarming may include sending a control signal to an operably attached display unit 902 or alarm 903. ECS 240 may include circuitry for receiving data from one or more sensors, circuitry for evaluating received data for one or more predetermined cold storage set point values, circuitry to send a control signal in response to a detected value that meets one or more predetermined set point values, and circuitry to transmit the received data externally to the APRU. ECS 240 may be configured to receive data from multiple temperature sensors; to evaluate the received data relative to predetermined maximum and/or minimum values; to send a control signal in response to a detected maximum and/or minimum value; and to send a signal including the received data to a monitoring system.

In various embodiments, the condenser heatsink may be a metallic device absorbs heat by conduction from condenser 210 and expels heat into ambient surroundings. The PCM may operate as a heatsink that absorbs and releases energy from the storage compartment by changing phase or temperature. The refrigeration system may transfer energy from the PCM to the condenser at a rate proportional to the compressor cooling capacity. When the refrigeration system is not running, energy may be transferred to the PCM while the heatsink 110 expels heat to the environment to cool condenser 210.

In various embodiments, capacity or size of compressor 300 may be selected to quickly cool APRU in response to system startup. Compressor 300 may thus have surplus cooling capacity compared to the heat passing into the cooling chamber through the insulation during operation. By selectively sizing of the compressor capacity, the running time of the refrigeration system may be shorter than the idle time to conserve battery power. The PCM may exchange energy to maintain a constant temperature due to phase changes. PCM may be disposed about the internal storage compartment in the walls of the APRU case. The PCM thus tends to maintain the internal storage compartment at a predetermined temperature. The condenser may cool passively without a fan. APRU may conserve battery power by passively cooling the refrigeration system without a fan.

The APRU may efficiently use battery power in response to the high R value of the APRU insulation. The case may be insulated with an R value of at least 35, 36, 37, 38, 39, or 40° F.*ft2*h/btu per inch. Heat generated by the APRU may be expelled efficiently in response to passively cooling the condenser. The APRU may include electronic control system configured to monitor the internal storage temperature and system status. APRU may tend to minimize battery consumption in response to efficient refrigeration duty cycle (e.g., compressor operating), long hold-over during passive cooling (e.g., compressor inoperative), and efficient heat transfer.

Figure 10A:
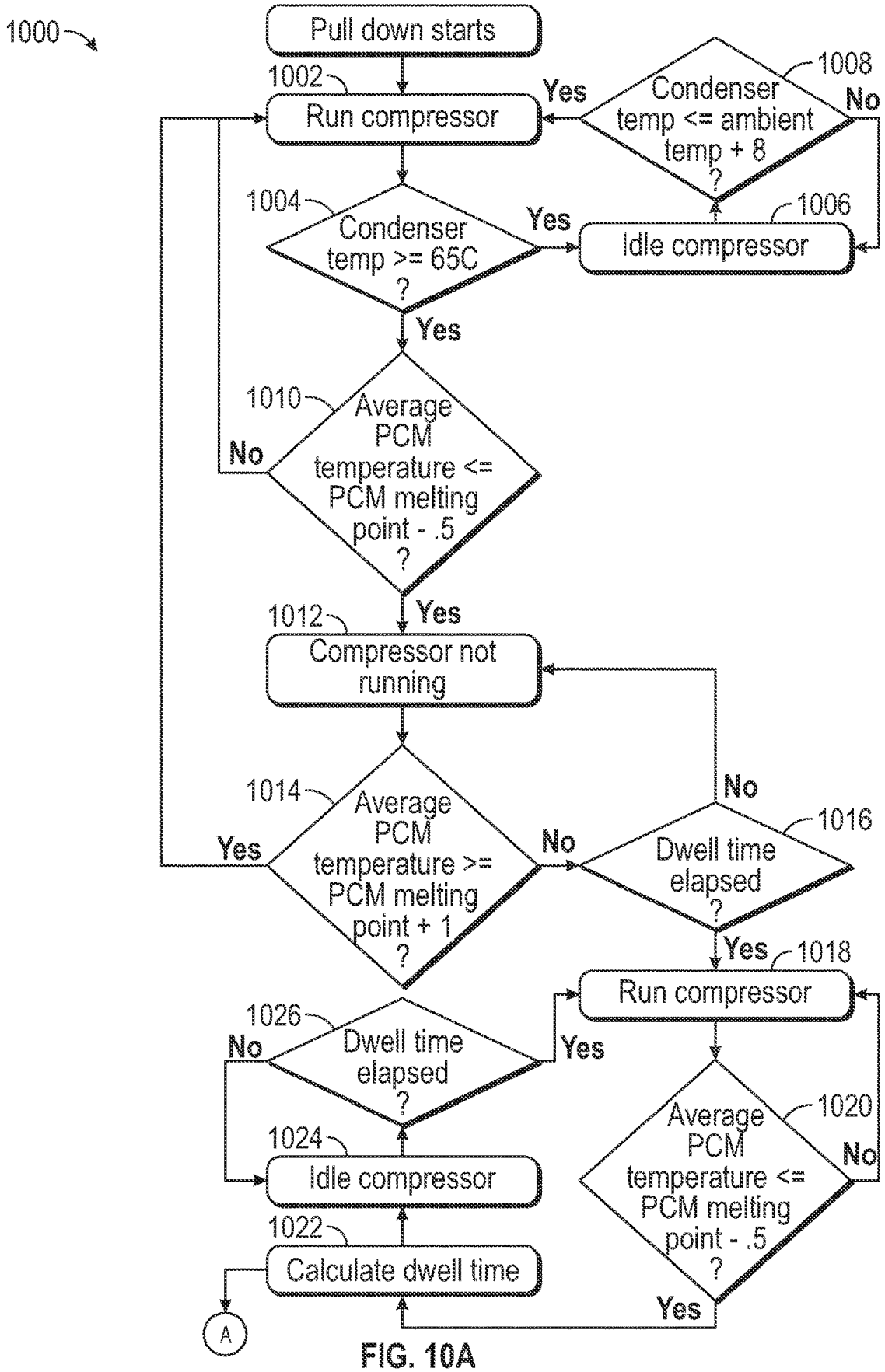
FIG. 10A illustrates a first portion of a process for controlling an APRU, in accordance with various embodiments.
Figure 10B:
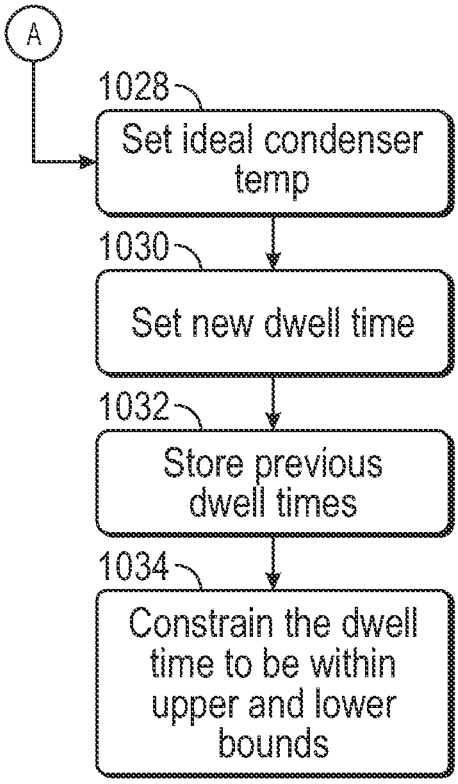
FIG. 10B illustrates a second portion of a process for controlling an APRU, in accordance with various embodiments.

With reference to FIG. 10, a process 1000 for execution by ECS 240 is shown to manage the duty cycle of compressor 300 (of FIG. 2), in accordance with various embodiments. Process 1000 may control compressor running time and compressor idle time by running or stopping compressor 300. Idle time is also referred to as system dwell time. Process 1000 may manage an initial cooling cycle differently than cooling cycles during ongoing operation.

In various embodiments, process 1000 may comprise instructions stored in the APRU memory and executed by a microprocessor to control APRU operation. APRU 101 may be plugged into a power source or operate from battery power on initial cooling in response to being activated. APRU 101 may bring storage compartment 150 to a predetermined temperature or set point during startup. APRU 101 may operate alternative power such as a battery without further user input after the initial cooldown sequence (e.g., autonomously). Process 1000 tends to minimize battery consumption, tends to maximize dwell time, and tends to maximize duration of operation without further human input. Compressor duty cycle and dwell time may be controlled by process 1000, which tends to minimize compressor on time and tends to maximize dwell time for efficient operation. In that regard, process 1000 may tend to maximize the duration APRU can maintain the predetermined cold-storage temperature for ambient conditions.

Figure 11:
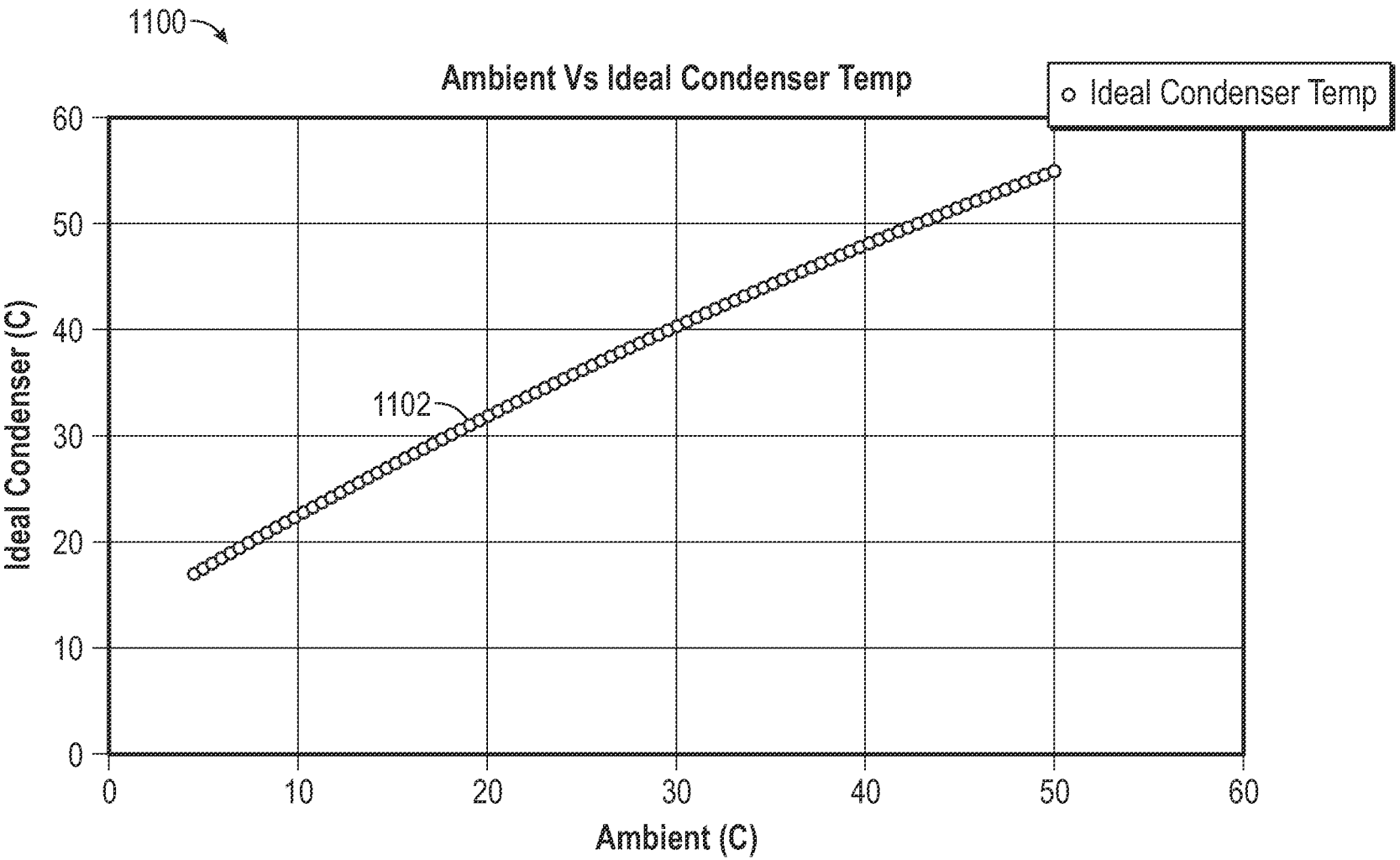
FIG. 11 illustrates graph of a condenser temperature in an APRU relative to ambient temperature, in accordance with various embodiments.

In various embodiments, ECS 240 may run compressor 300 (Block 1002). ECS 240 may check whether a temperature of the condenser is less than or equal to a max compressor temperature (Block 1004). A target condenser temperature may be about 60° C., 65° C., 70° C., 75° C., or 80° C., for example. ECS 240 may calculate a target condenser temperature using a function of ambient temperature or APRU conditions. Referring briefly to FIG. 11, ECS 240 may lookup or calculate the target condenser temperature using a lookup table or lookup function. For example, ECS 240 may use a lookup function as shown in plot 1102 to determine a target condenser temperature. Returning to FIG. 10, ECS 240 may shut down or idle compressor 300 in response to the measured condenser temperature being greater than (or equal to) the maximum condenser temperature (Block 1006). Maximum condenser temperature may be a predetermined parameter based on physical characteristics of compressor 300.

In various embodiments, ECS 240 may check whether the condenser temperature is greater than ambient temperature plus an ambient offset (Block 1008). Ambient temperature may be measured from the air around APRU 101. A suitable ambient offset may be, for example, 5° C., 6° C., 7° C., 8° C., 9° C., 10° C., or another offset from the variable ambient temperature that tends to maximize efficiency of compressor 300. Although whole numbers are shown, ambient offset may be set to any real number within ranges of +/1 of the example ambient offsets above. ECS 240 may continue idling compressor 300 in response to the condenser temperature being greater than the ambient offset. ECS 240 may run compressor 300 in response to the condenser temperature being less than the ambient temperature plus the ambient offset.

In various embodiments and in response to the measured condenser temperature being less than the max condenser temperature, ECS 240 may check whether the measured PCM temperature is less than or equal to the PCM-cooling-target temperature (Block 1010). The PCM-cooling-target temperature may be a constant equal to the melting point of PCM minus a temperature offset, though other PCM-cooling-target temperatures may be selected in various embodiments. A suitable temperature offset may be, for example, 0.25° C., 0.5° C., 0.75° C., 1° C., or 1.5° C. Suitable temperature offsets may include any real number in the range (0,3). ECS 240 may idle the compressor in response to the PCM temperature being less than or equal to the PCM-cooling-target temperature (Block 1012). ECS 240 may check in Block 1012 whether a desired amount of PCM has frozen. ECS 240 may use measurements from temperature sensors near to or contacting the PCM to determine whether a desired amount of PCM has frozen.

In various embodiments, the PCM-cooling-target temperature may be just below the freezing point of the PCM to freeze substantially all of the PCM before triggering a compressor shutdown in response to the measured PCM temperature. The measured PCM temperature may be an average temperature of PCM measured by different sensors. The measured PCM temperature may be the highest or lowest temperature measured by different sensors. The measured PCM temperature may be a single measured temperature of the PCM. A small PCM-cooling-target temperature offset tends to increase the efficiency of APRU by reducing excess cooling applied to PCM in its solid state provided that the small PCM-cooling-target temperature offset allows sufficient time to freeze substantially all of the PCM.

In various embodiments, ECS 240 may check whether the PCM temperature is greater than (or equal to) a PCM-warming-target temperature (Block 1014). The PCM-warming-target temperature may be equal to the PCM melting point plus a temperature offset. A suitable temperature offset may be 0.5° C., 1° C., 1.5° C., or 2° C., for example. Suitable temperature offsets for the PCM-warming-target temperature may include any real number in the range (0,3). The PCM melting point may be between the PCM-cooling-target temperature and the PCM-warming-target temperature to facilitate phase changes between liquid and solid in response to the PCM temperature fluctuating between the PCM-warming-target temperature and the PCM-cooling-target temperature, respectively.

In various embodiments, ECS 240 may check whether a target dwell time has elapsed since ECS 240 idled compressor 300 (Block 1016). The target dwell time may be initialized as a predetermined value. ECS 240 may set the initial target dwell time as a calculated value based on measured running time of condenser 210 and temperature conditions in APRU 101. ECS 240 may adjust the target dwell time in response to measured running time of condenser 210 and temperature conditions in APRU 101.

In various embodiments, ECS 240 may continue idling compressor 300 in response to the elapsed dwell time being less than the target dwell time. ECS 240 may run compressor 300 in response to the elapsed dwell time being greater than (or equal to) the target dwell time (Block 1018).

In various embodiments, ECS 240 may check whether the PCM temperature is less than (or equal to) the PCM-cooling-target temperature (Block 1020). In that regard, ECS 240 may be checking whether enough PCM has frozen to stop the compressor 300. ECS 240 may continue running compressor 300 in response to the PCM temperature being greater than the PCM-cooling-target temperature (Block 1018).

In various embodiments, ECS 240 may determine a new target dwell time in response to the PCM temperature reaching the PCM-cooling-target temperature (Block 1022). ECS 240 may calculate a target condenser temperature (Block 1028). The target condenser temperature may tend to be an efficient operating temperature for condenser 210 based on ambient conditions and APRU conditions. For example, ECS 240 may set the ideal condenser temperature using equation (1), where $K_1$ and $K_2$ are constants, IdealCondenserTemp is the target temperature for condenser 210, AmbientTemp is an ambient temperature outside APRU 101, and SetPoint is the previous target temperature for condenser 210.

$$\text{IdealCondenserTemp}=-K_1*((\text{AmbientTemp}-\text{SetPoint})^{99})+K_2/(1-(40-\text{SetPoint})^{99})^2 \quad (1)$$

ECS 240 may use other equations to set the ideal condenser temperature. The constant K1 may be equal to 41. The constant K2 may be equal to 56. Other values for constant K1 may be suitable such as, for example, 38, 39, 40, 42, 43, 44, or 45. Other values for constant K2 may be suitable such as, for example, 52, 53, 54, 55, 57, 58, 59, or 60.

In various embodiments, ECS 240 may calculate a target dwell time based on the target condenser temperature and the condenser temperature (Block 1030). For example, ECS 240 may determine whether an ideal condenser temperature is less than the current condenser temperature. ECS 240 may use equation (2) to set a new dwell time, where DwellTime is the new dwell time, K3 is a constant, and AmbientTemp is a temperature measured outside APRU 101.

$$\text{DwellTime}=-K_3*((\text{AmbientTemp})^2+1/(1-(6)^2)^2 \quad (2)$$

ECS 240 may use other functions to set the ideal condenser temperature. The constant $K_3$ may be equal to 6. Other values for constant $K_3$ may be suitable such as, for example, 4, 5, 7, 8. Although integral numbers are shown by way of example, any real numbers within ranges of +/−1 from the exemplary constants above may be used for constants described herein.

In various embodiments, ECS 240 may modulate the new target dwell time based on the based on previous target dwell times (Block 1032). ECS 240 may thus tend to limit the magnitude of shift between consecutive or recent target dwell times. Dwell time old may comprise a data structure retaining previous dwell times. For example, dwell time old may comprise an array A[n] of the previous three dwell times with n=2 being most recent and n=0 being the oldest of the last three dwell times.

In various embodiments, ECS 240 may constrain the target dwell time between an upper bound and lower bound (Block 1034). The upper bound and lower bound may be a function of ambient temperature. With brief reference to FIG. 12, ECS 240 may determine the upper bound and lower bound using lookup functions similar to plots 1202 and 1204. Lower bounds and upper bounds may be set using equations (3) and (4), respectively.

$$\text{LowerBound}=K_{L1}*((\text{AmbientTemp}-\text{SetPoint})^{0.93}+K_{L2}/(1-(53-\text{SetPoint})^{0.93})^2 \quad (3)$$

$$\text{UpperBound}=K_{U1}*((\text{AmbientTemp}-\text{SetPoint})^{0.93}+K_{U2}/(1-(53-\text{SetPoint})^{0.93})^2 \quad (4)$$

In equation (3), $K_{L1}$ may be the first lower bound constant equal to about 21,300 and $K_{L2}$ may be the second lower bound constant equal to about 300. In equation (4), $K_{U1}$ may be the first upper bound constant equal to about 60,800 and $K_{U1}$ may be the second upper bound constant equal to 4,000. The upper and lower bound constants may be any real number within +/−5%, +/−10%, or +/−15% of the example upper and lower bound constants given above.

Returning to FIG. 10 and in accordance with various embodiments, ECS 240 may idle compressor 300 in response to the PCM temperature being less than (or equal to) the PCM-cooling-target temperature. ECS 240 may check whether compressor 300 has been idling for a period greater than or equal to the updated target dwell time (e.g., determined in Blocks 1028 through 1034) to determine whether to restart compressor 300 (Block 1026). In response to a period greater than (or equal to) the target dwell time elapsing with compressor 300 being idle, ECS 240 may run compressor 300 (Block 1018). In response to a period less than the target dwell time elapsing with compressor 300 being idle, ECS 240 may continue idling compressor 300 (Block 1024).

In various embodiments, ECS 240 may tend to run compressor 300 when PCM is in liquid state. ECS 240 may tend to idle compressor 300 when PCM is in a frozen state. In that regard, ECS 240 oscillates the PCM temperature between the PCM-cooling-target temperature and the PCM-warming-target temperature. Active cooling may occur while the condenser 210 is running. Passive cooling may occur when condenser 210 is idle and PCM is melting in response to the PCM absorbing heat from storage compartment 150 or ambient surroundings to urge the PCM phase change from solid to liquid.

With reference to FIG. 11, graph 1100 is shown with plot 1102 of ambient temperature against desired condenser temperature, in accordance with various embodiments. Plot 1102 may represent values of a lookup table plotted in graph form. Plot 1102 may represent values of a lookup table plotted in graph form. Plot 1102 operate as a lookup function stored in memory and used by the electronic control system to determine the desired condenser temperature in response to measured ambient temperatures. Plot 1102 may vary for different APRU embodiments including various condenser, condenser heatsink (the heat transfer rate) including material, size, condenser thermal capacity, and condenser heatsink cooling capacity and efficiency, heat load and heat transfer rate from the refrigerant in the evaporator to the storage compartment. Thus, plot 1102 serves as an example lookup function for certain APRU configurations.

Figure 12:
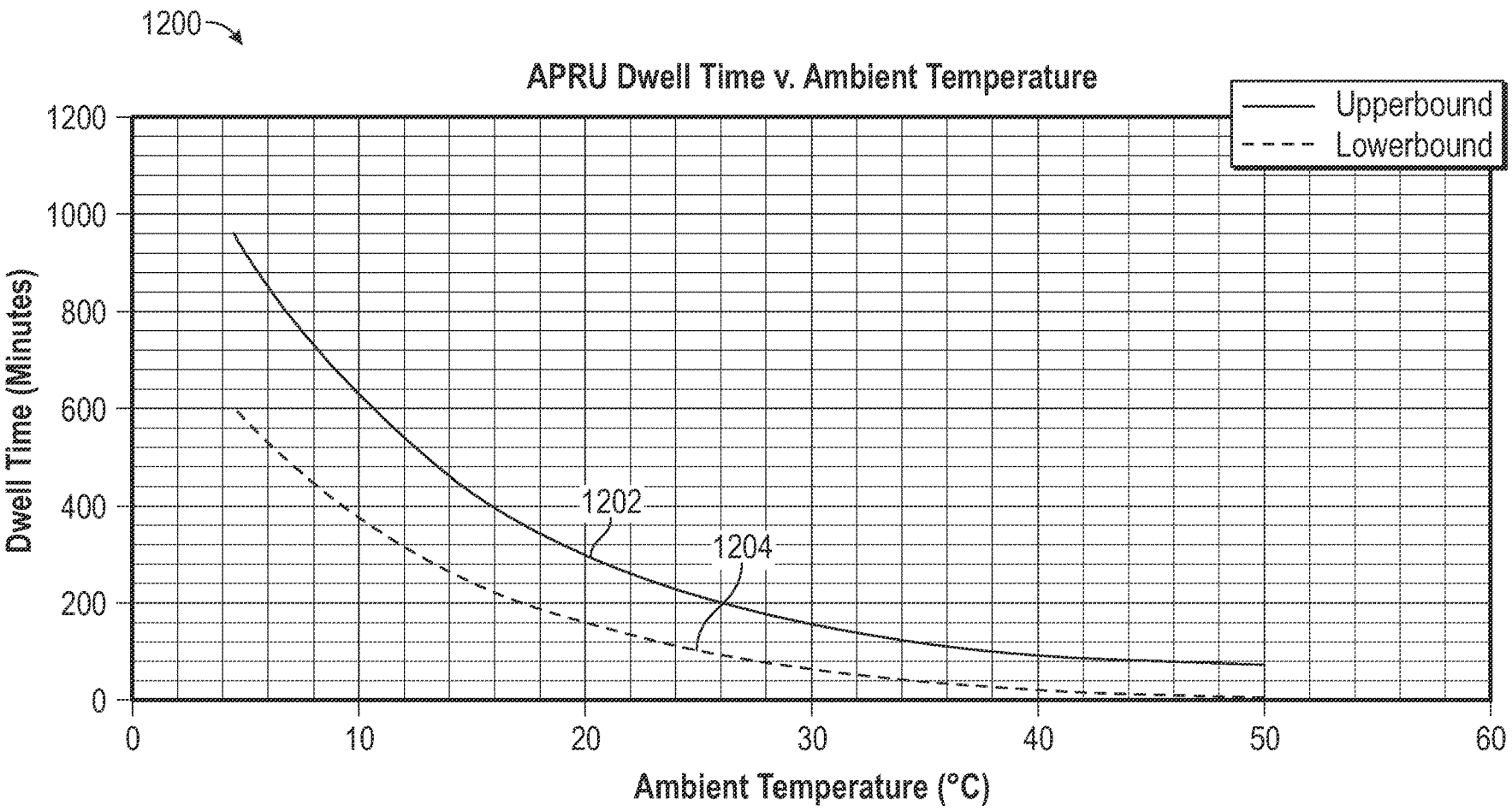
FIG. 12 illustrates graph of APRU dwell time relative to ambient temperature, in accordance with various embodiments.

Referring now to FIG. 12, graph 1200 is shown comprising an upper bound plot 1202 and a lower bound plot 1204 of desired APRU dwell time versus measurable ambient temperatures, in accordance with various embodiments. Upper bound plot 1202 and lower bound plot 1204 may each represent values of a lookup table plotted in graph form. The electronic control system in an APRU may reference upper bound plot 1202 and lower bound plot 1204 to determine the dwell time of the APRU for a measured ambient condition. Plot 1202 and plot 1204 may differ in response to various embodiments of the refrigeration system, the APRU thermal efficiency, the PCM type and thermal capacity, heat transfer rate into the PCM, or other factors that may change the target dwell time for a measurable ambient temperature. In that regard, plot 1202 and plot 1204 may serve as examples of lookup functions for certain APRU configurations.

Figure 13:
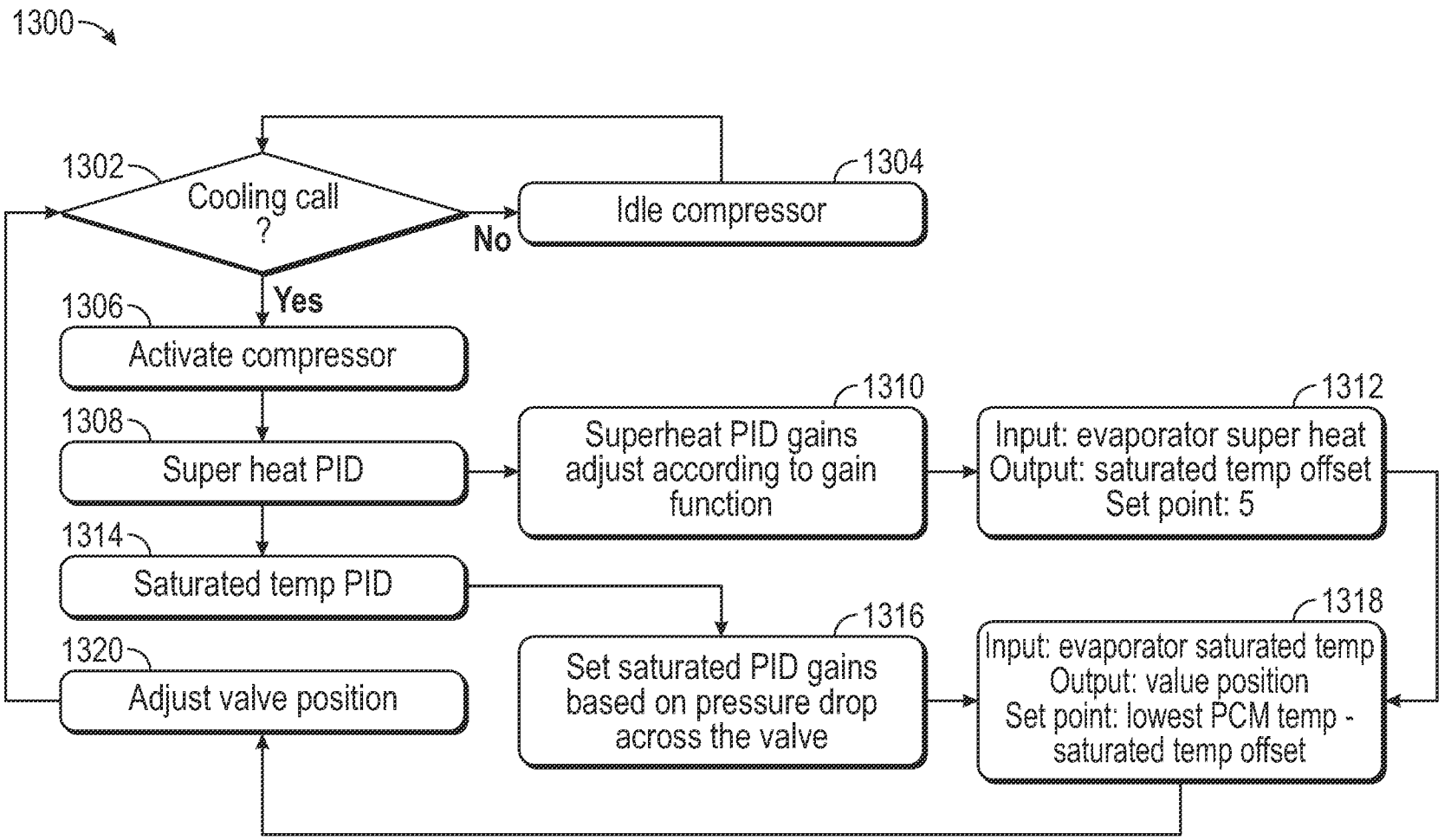
FIG. 13 illustrates a process for controlling an APRU using proportional-integral-derivative (PID) controller, in accordance with various embodiments.

With reference to FIG. 13, process 1300 is shown for controlling expansion valve 350, in accordance with various embodiments. Process 1300 may actuate expansion valve 350 in response to evaporator superheat and saturation temperatures. In that regard, process 1300 may tend to optimize phase changes in PCM in response to evaporator superheat levels and saturation temperatures. Process 1300 may also tend to optimize conditions at the evaporator outlet or compressor inlet. The term superheat as used herein may refer to a difference between the temperature of refrigerant vapor and the saturation temperature of refrigerant at the same point.

In various embodiments, ECS 240 (of FIG. 9) may run process 1300 of APRU 101 (of FIG. 2). ECS 240 checks for a pending cooling call (Block 1302). A cooling call may indicate temperatures in storage compartment 150 or other areas of APRU are above target levels or maximum levels. A cooling call may indicate the PCM as a temperature higher than desired or that a dwell time has elapsed. A cooling call may thus result in running compressor 300.

In various embodiments, ECS 240 may idle compressor 300 in the absence of a cooling call (Block 1304). ECS 240 may run compressor 300 in response to detecting a cooling call (Block 1306). ECS 240 may check superheat PID (Block 1308). Superheat PID gains may increase according to a gain function (Block 1310). The gain function may be a function the same as or similar to the functions plotted in graph 1400 (of FIG. 14). In that regard, ECS 240 may look up or calculate a gain value based on a superheat value. ECS 240 may receive as input the evaporator superheat as measured at the evaporator outlet. ECS 240 may output a saturated temperature offset, with an initial saturation temperature offset being predetermined. A suitable initial saturation offset may be 3° C., 4° C., 5° C., 6° C., 7° C., or 8° C., for example. Although integral numbers are shown by way of example, any real numbers within ranges of +/−1 from the exemplary constants above may be used for the saturation offset.

In various embodiments, ECS 240 may check saturation temperature PID (Block 1314). ECS 240 may set the saturated PID gains based on a measured pressure drop across expansion valve 350 (Block 1316). ECS 240 may lookup or calculate the saturated PID gain based on the pressure drop measured across valve 350. A lookup value or function may be the same as or similar to the functions plotted in graph 1500 (of FIG. 15). ECS 240 may receive as input the saturated temperature measured at the evaporator outlet. ECS 240 may receive as input a pressure at the evaporator outlet and calculate the saturated temperature. ECS 240 may select a new valve position based on saturated temperature, lowest PCM temperature, and the saturated temperature offset (Block 1318). ECS 240 may actuate the position of expansion valve 350 in a manner that tends to maximize cooling efficiency (Block 1320).

Figure 14:
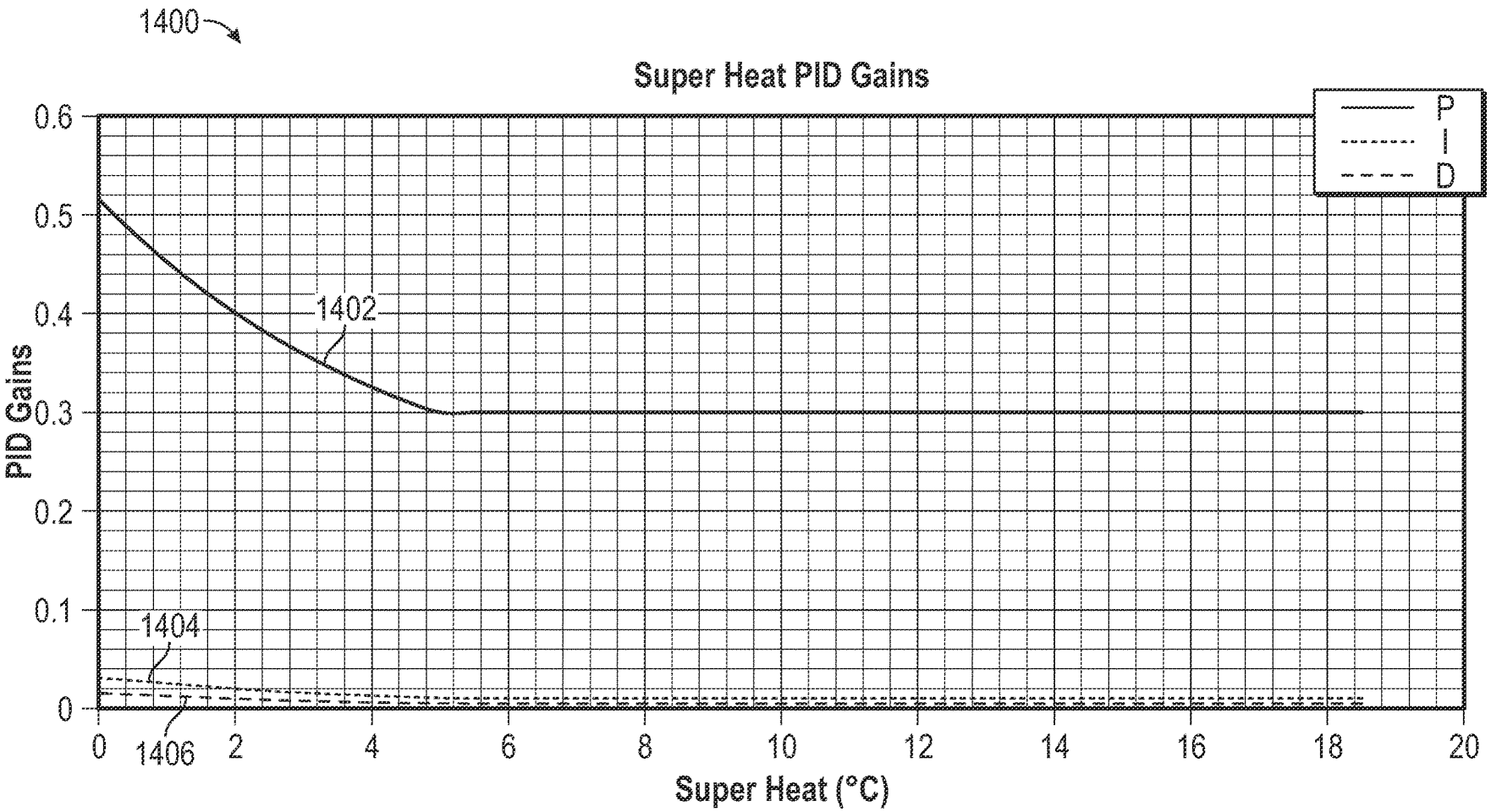
FIG. 14 illustrates a graph of PID gains against superheat temperature, in accordance with various embodiments.
Figure 15:
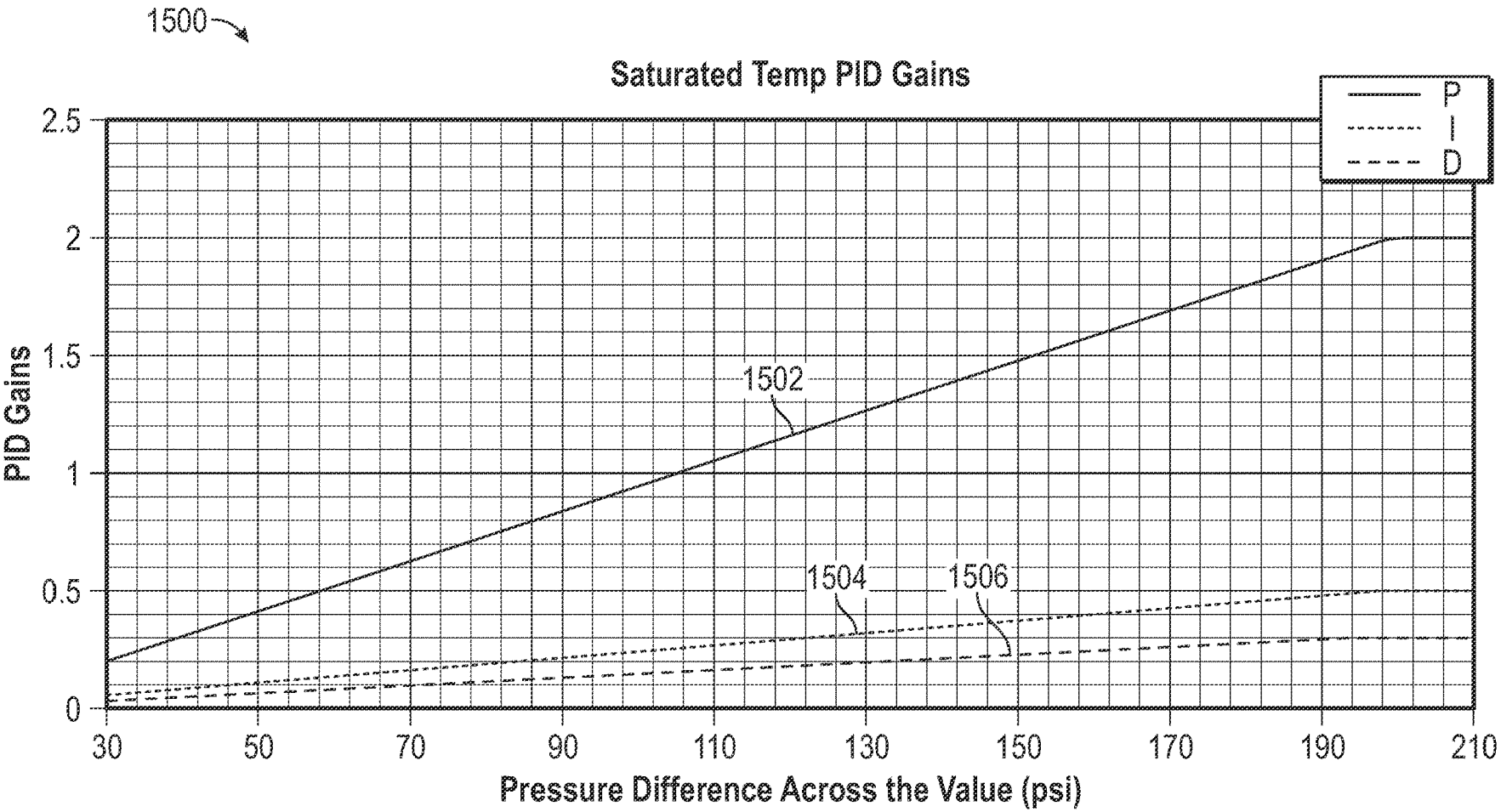
FIG. 15 illustrates a graph of PID gains against pressure differential across a valve, in accordance with various embodiments.

Referring now to FIG. 14 and FIG. 15, graphs 1400 and 1500 are shown, in accordance with various embodiments. Graph 1400 comprises plots 1402, 1404, and 1406 of PID gains versus super heat. Graph 1500 comprises plots 1502, 1504, and 1506 of PID gains versus pressure difference across expansion valve 350. Process 1300 (of FIG. 13) may reference plot 1402 and plot 1502 as lookup tables to achieve desired conditions. Plots 1402 and 1502 may vary based on configuration of the APRU. Plot 1402 and plot 1502 may thus serve as lookup functions for reference by ECS 240 to determine the commands to be provided to the electronic controlled expansion valve 350. Process 1300 may reference the plots to achieve a desired pressure drop across expansion valve 350 in order. ECS 240 may control APRU to the desired evaporator saturation and superheat temperatures in response to measured operating conditions.

Returning to FIG. 13, compressor 300 may run until a predetermined PCM temperature is measured to freeze the PCM. The duration of the compressor operation may be proportional to the amount of cooling needed to achieve the desired PCM temperature. Process 1300 may seek to run compressor for a duration that tends to maximize cooling efficiency. Running compressor 300 for too short of a duration may result in transient startup and shut-down operation reducing efficiency due to poor superheat control. Running compressor 300 for too long of a duration may heat the passive condenser, increase refrigerant high side pressure, and reduce efficiency. An optimum running duration may correlate to an optimum maximum condenser temperature for a measured ambient temperature. The temperature difference as a function of ambient temperature may vary based on individual heat transfer characteristics of the condenser heat exchanger system.

In various embodiments, ECS 240 may adjust (e.g., increase or decrease) the duration APRU is in passive cooling mode using a PID controller. In the proportional-integral control, the desired condenser surface temperature may be the predetermined temperature, and the passive cooling time duration may be determined based on Delta T (Ideal−actual)*Gain/multiplier (Hx #1 specific)=(% dwell time change).

In various embodiments, the processes described herein may maintain the desired PCM setpoint temperature and a desired condenser temperature with a compressor run time duration. APRU may maintain the desired temperatures by adjusting the duration of the compressor "off time" and thereby the total cycle time. The amount of PCM warmed and melted may be proportional to the "off time" and the ambient temperature for a fixed heat leak rate through the container insulation. A short "off time" may result in little PCM warming and thawing and melting, thus little cooling may be applied to refreeze and cool the PCM. PCM may be cooled down to the desired temperature by operating the compressor. Lower cooling demands may result in a short duration compressor run duration.

In various embodiments, idling compressor 300 for a longer duration may tend to allow more PCM to melt. More cooling may be applied to refreeze PCM. Greater cooling an APRU may come from running compressor 300 for longer durations, which may generate more heat at the condenser. A desired "off time" may be identified found by proportional (e.g., integral control) feedback using the desired condenser temperature as a setpoint and the duration of idle time for compressor 300 as the process variable. The compressor cooling may achieve the PCM setpoint temperature simultaneously with the maximum desired condenser temperature at any ambient condition.

In various embodiments, an aluminum roll bond plate evaporator may be submerged in, or in contact with, the PCM. An expansion valve may meter refrigerant into the top evaporator tube. A compressor suction line may draw from the bottom tube. This configuration may deliver greater cooling to the top portion of APRU 101 in the area where the lid opens and closes.

In various embodiments, the suction line may include a surface mount thermistor or other temperature sensor at the exit of the evaporator. An electronic pressure gauge may be attached to the bottom of the evaporator. The temperature sensor and pressure sensor may generate measurements used by the ECS to calculate superheat. Temperature sensors may measure the temperature of the PCM at a distance from the evaporator surface. Metering refrigerant may control superheat and saturation pressures. Metering refrigerant may thus control saturation temperature. APRU 101 may maintain the saturation temperature at a lower temperature than the coldest measured PCM by a predetermined amount. APRU 101 may maintain the superheat above a fixed minimum value. Expansion valve 350 may maintain saturation temperature to less than the suction line temperature by the predefined superheat temperature difference in response to the PCM reaching a substantially uniform temperature. The foregoing systems and processes may allow both freezing of PCM from top to bottom during pulldown and sub-cooling of PCM from bottom to top during a complete cycle. This reversal of temperature gradient during may occur in response to a saturated temperature and superheat-based expansion valve control. APRU 101 may thus flip the cooling direction between bottom-to-top and top-to-bottom to cool a submerged evaporator.

In various embodiments, the lowest desirable temperature for effective blood storage may be about 2 C. Other temperature-sensitive materials may have different critical temperatures. APRU 101 configured for blood storage may comprise a heater system to maintain a temperature of approximately 3° C. 3° C. may be lower than the freezing point of the PCM in APRU 101. APRU 101 in the foregoing configuration may maintain PCM in a frozen state during heating. APRU 101 may thus prevent the heater from melting PCM and wasting cooling potential. The temperature sensor at the bottom of the PCM container may be used for heater control.

In various embodiments, APRU 101 may comprise proportional feedback to control the heater using pulse width modulation (PWM). Other heater control systems may also be used. APRU 101 may control the heater to maintain the temperature at a predetermined level (e.g., approximately 2° C., 3° C., 4° C., 5° C., 6° C.). As used herein, terms such as approximately, substantially, or about, when used with temperatures may mean+/−0.1° C., +/−0.2° C., +/−0.3° C., +/−0.4° C., or +/−0.5° C. The location of the heater element and the distribution of heating power may distribute heat inside the APRU 101. APRU 101 may thus tend to maintain a temperature below the melting point of the selected PCM. The bottom and the sides of the exterior of the PCM containment vessel may be heated. A ratio of heating distribution of the sides to the bottom may be 5.2 to 1, although other ratios may be selected for various PCM selections and APRU configurations. A 1/32-inch-thick aluminum plate may distribute heat across the bottom of APRU 101, though other thicknesses and other conductive materials may be used as a heating plate in APRU 101.

In various embodiments and generally referring again to FIGS. 1-15, systems and methods described herein may provide autonomous and portable temperature regulation of temperature sensitive payloads in extreme environmental conditions for extended continuous operation without the constant use of external power sources. In various embodiments, a battery 260 powered ECS 240 (ECS) refrigeration system 99 (e.g., a fanless system) used in conjunction with a storage housing 220 (e.g., a double-walled assembly), PCM 512, a passively cooled condenser section coil 209, and compressor 300, a storage housing 220, coil of evaporator 506, heating element 510, and expansion valve 350 to optimize the active/passive refrigeration duty cycle, system efficiency, and battery 260 usage.

In various embodiments, APRU 101 may tend to optimize refrigeration duty cycle efficiency over a very wide range of operating conditions by managing the amount of PCM 512 that thaws and the corresponding compressor run time to refreeze the PCM. APRU 101 may also tend to optimize the operating temperatures of the condenser in response to ambient conditions. Evaporator temperature and pressure control system may cool the evaporator 506 and PCM 512 closest to the location of earliest melting at the top of the APRU thereby preserving the uniform temperature distribution of the storage compartment during refreezing.

In various embodiments, APRU 101 may allow for various refrigeration loads and storage compartment temperature set points. Refrigeration system 99 (of FIG. 1) and its subcomponents (e.g., compressor 300, condenser 210, expansion valve 350, and heat transfer systems may be sized for flexibility. APRU 101 may comprise a case with a case bottom 107, sides 105, top 106, and lid assembly 290 forming case 100. Case 100 is depicted in rectangular shape, though other shapes may be used. Case 100 may be rugged (e.g., resistant to shock, water, heat, cold, and vibration). Case 100 may be waterproof. Case 100 may comprise a storage compartment 150 having of one or more double walls (e.g., inner bucket 500 within outer bucket 503 defining double walls), a refrigeration system 99 (e.g., passively cooled, without cooling a fan) to service a predetermined refrigeration load and maintain a predetermined temperature in a storage compartment. The evaporator coils positioned within the interior of the cold-storage compartment may be in contact with a PCM and at least one expansion valve. Various conduits may be coupled to and in fluid communication with the compressor, condenser, and evaporator forming a liquid and vapor flow path between the interiors of the compressor, condenser, and evaporator.

In various embodiments, APRU 101 (of FIG. 2) comprises a case 100 (of FIG. 2). Case 100 may have a refrigeration system 99 (e.g., a fanless system) described above. APRU 101 may comprise a case, liquid-impermeable container and a fanless refrigeration unit. APRU 101 may also comprise a battery 260 and a control system. The control system may be in electronic communication with attached to the battery 260, refrigeration system 99, and a sensor.

In various embodiments, APRU 101 may comprise case 100, storage housing 220 (e.g., a liquid-impermeable assembly), refrigeration system 99 (i.e., a fanless active vapor compression refrigeration system), sensors, and ECS 240 (e.g., a battery powered electronic system). APRU 101 may store historic cold-storage temperature records and system health information to provide the user information regarding the condition of the contents over time. APRU 101 may transmit such data to the user wirelessly or thorough a visual indicator on the user interface 160.

In various embodiments, APRU 101 may comprise a case, liquid-impermeable container, fanless refrigeration unit, sensors, battery powered control system, and monitoring systems to optimize the compressor duty cycle such that the APRU system maintains a selected temperature in the storage compartment for up to 100 hours in ambient temperatures approximately between −25° F. to 120° F.

Benefits, other advantages, and solutions to problems have been described herein regarding specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cooled storage system, comprising:

a case including:

an outer bucket comprising a first bottom wall and a first sidewall, the outer bucket comprising a first flange protruding from the first sidewall;

an inner bucket disposed at least partially within the outer bucket, wherein the inner bucket comprises a second bottom wall and a second sidewall defining a storage compartment in the case, wherein the inner bucket comprises a second flange protruding from the second sidewall, the second flange engaged with the first flange, and wherein a volume is defined between the inner bucket and the outer bucket;

an electronic control system coupled to the case and configured to maintain a predetermined temperature in the storage compartment;

a refrigeration system disposed in the case and comprising:

a compressor;

a first heatsink comprising first cooling fins exposed from the case at a first exterior wall of the case, the first heatsink being in thermal communication with the compressor and having a contour to receive the compressor;

a condenser having an inlet of the condenser in fluid communication with an outlet of the compressor;

a second heatsink comprising second cooling fins exposed from the case at a second exterior wall of the case, the second heatsink being in thermal communication with the condenser and having a contour to receive the condenser;

an expansion valve having an inlet of the expansion valve in fluid communication with an outlet of the condenser;

an evaporator comprising a coil, wherein an inlet of the coil is in fluid communication with an outlet of the expansion valve, where an outlet of the coil is in fluid communication with an inlet of the compressor, and wherein the coil is at least partially disposed in the volume between the inner bucket and the outer bucket; and a phase-change material disposed in the volume between the inner bucket and the outer bucket, wherein the evaporator is at least partially submerged in the phase-change material.

2. The cooled storage system of claim 1, wherein the case is insulated with an R value of at least 35° F.*ft$^2$*h/BTU per inch.

3. The cooled storage system of claim 1, further comprising a lid hingedly coupled to the case above the storage compartment, wherein the lid seals the storage compartment in response to being in a closed position.

4. The cooled storage system of claim 1, wherein the phase-change material comprises a thermal storage capacity of approximately 200 J/gr, and wherein the phase-change material is configured to absorb heat from the storage compartment.

5. The cooled storage system of claim 1, further comprising a battery disposed in the case and in electronic communication with the compressor.

6. The cooled storage system of claim 4, wherein the outer bucket comprises a rim defining a channel for the inlet of the coil and the outlet of the coil to exit the volume.

7. The cooled storage system of claim 5, wherein the electronic control system is in electronic communication with the battery and the compressor, wherein the electronic control system configured to maintain a predetermined temperature in the storage compartment.

8. The cooled storage system of claim 7, further comprising a user interface system mounted on the case and in communication with the electronic control system, wherein the user interface system is configured to alarm in response to at least one of a measured temperature in the storage compartment, a historical temperature measured in the storage compartment, and remaining power in the battery.

9. The cooled storage system of claim 8, wherein the first heatsink at least partially defines an external side of the cold storage system.

10. A cooled storage system, comprising:

a case comprising an outer wall at least partially defined by a heatsink;

an outer bucket disposed in the case and coupled to the case;

an inner bucket disposed at least partially within the outer bucket, wherein a sealed volume is defined between the inner bucket and the outer bucket, wherein interior surfaces of the inner bucket define a storage compartment;

an electronic control system coupled to the case and configured to maintain a predetermined temperature in the storage compartment;

a refrigeration system disposed in the case, in thermal communication with the heatsink, and comprising:

a condenser disposed in the case;

an expansion valve in fluid communication with the condenser; and an evaporator coil in fluid communication with the expansion valve and disposed at least partially in the sealed volume between the inner bucket and the outer bucket, wherein the electronic control system adjusts a proportional-integral-derivative (PID) gain in response to a pressure drop across the expansion valve; and a phase-change material disposed in the sealed volume between the inner bucket and the outer bucket, wherein the evaporator coil is at least partially submerged in the phase-change material;

the refrigeration system further comprising a compressor disposed in the case and outside of the outer bucket, the compressor in fluid communication with the evaporator coil;

wherein the heatsink comprises first cooling fins exposed from the outer wall of the case, the heatsink being in thermal communication with the compressor and having a contour to receive the compressor.

11. The cooled storage system of claim 10, wherein the cooled storage system is configured to cool the storage compartment to the predetermined temperature while the compressor idles in response to the phase-change material melting.

12. The cooled storage system of claim 10, wherein the electronic control system is configured to receive a temperature measurement of the phase-change material, and to start the compressor in response to the temperature measurement being greater than or equal to a warming-target temperature.

13. The cooled storage system of claim 10, further comprising a battery disposed in the case and in electronic communication with the compressor.

14. The cooled storage system of claim 10, wherein the electronic control system is configured to maintain a predetermined temperature in the storage compartment.

15. The cooled storage system of claim 10, further comprising a lid hingedly coupled to the case above the storage compartment, wherein the lid seals the storage compartment in response to being in a closed position.

16. The cooled storage system of claim 12, wherein the warming-target temperature is set in the electronic control system as a constant equal to a melting point of the phase-change material plus a temperature offset.

17. The cooled storage system of claim 16, wherein the temperature offset is one of about 0.25° C., about 0.5° C., about 0.75° C., or about 1° C.

18. The cooled storage system of claim 13, wherein the electronic control system is in electronic communication with the battery and the compressor.

* * * * *